US007558081B2

(12) United States Patent
Green et al.

(10) Patent No.: US 7,558,081 B2
(45) Date of Patent: Jul. 7, 2009

(54) BASIC HALOGEN CONVERTOR IC

(75) Inventors: Peter Green, Redondo Beach, CA (US); Iulia Rusu, Redondo Beach, CA (US)

(73) Assignee: International Rectifier Corporation, El Segundo, CA (US)

( * ) Notice: Subject to any disclaimer, the term of this patent is extended or adjusted under 35 U.S.C. 154(b) by 0 days.

(21) Appl. No.: 11/560,216

(22) Filed: Nov. 15, 2006

(65) Prior Publication Data

US 2007/0069658 A1 Mar. 29, 2007

Related U.S. Application Data

(60) Division of application No. 10/443,525, filed on May 21, 2003, now Pat. No. 7,321,201, which is a continuation of application No. PCT/US02/41836, filed on Dec. 30, 2002.

(60) Provisional application No. 60/343,236, filed on Dec. 31, 2001, provisional application No. 60/398,298, filed on Jul. 22, 2002.

(51) Int. Cl.
*H02M 3/335* (2006.01)
*H05B 37/02* (2006.01)

(52) U.S. Cl. ..... 363/21.03; 315/224; 315/209 R; 315/291; 363/21.01; 363/16; 363/40; 363/43

(58) Field of Classification Search ..... 315/224, 315/225, 209 R, 246, 247, 291, 307, 219; 363/16, 17, 21.1, 21.11, 21.13, 21.14, 21.17, 363/21.18, 43, 40, 52, 53, 55, 56.01, 56.02, 363/71, 74–80

See application file for complete search history.

(56) References Cited

U.S. PATENT DOCUMENTS 3,774,074 A 11/1973 Souvay
5,796,215 A 8/1998 Parry et al.
5,925,990 A 7/1999 Crouse et al.

(Continued)

FOREIGN PATENT DOCUMENTS

EP 0 758 160 2/1997

(Continued)

OTHER PUBLICATIONS

Japanese Office Action dated Jan. 30, 2007 and translation.

(Continued)

*Primary Examiner*—Tuyet Vo
(74) *Attorney, Agent, or Firm*—Farjami & Farjami LLP

(57) ABSTRACT

A driving circuit for providing a control signal to a power semiconductor device for providing power to a filament lamp, said driving circuit comprising an oscillator for generating said control signal. The driving circuit may further comprise a soft start circuit which controls said oscillator so as to avoid excessive current in said lamp at start-up; a voltage compensation circuit which controls said oscillator so as to compensate for variations in load; a shutdown circuit for shutting down and automatically restarting said oscillator in response to a fault condition; an adaptive dead time circuit which controls said oscillator for providing cool running of said power semiconductor device; and/or a dimming circuit which controls said oscillator for driving said lamp. The driving circuit and its control circuitry may be implemented in an integrated circuit.

9 Claims, 26 Drawing Sheets

U.S. PATENT DOCUMENTS

| | | | | |
|---|---|---|---|---|
| 6,002,213 | A | 12/1999 | Wood | |
| 6,008,593 | A | 12/1999 | Ribarich | |
| 6,211,623 | B1 * | 4/2001 | Wilhelm et al. | 315/224 |
| 6,617,805 | B2 | 9/2003 | Ribarich et al. | |
| 6,900,599 | B2 * | 5/2005 | Ribarich | 315/247 |
| 2003/0102823 | A1 | 6/2003 | Ribarich | |
| 2004/0085792 | A1 * | 5/2004 | Lin et al. | 363/131 |

FOREIGN PATENT DOCUMENTS

| | | |
|---|---|---|
| GB | 2244608 | 12/1991 |
| JP | 4-94097 | 3/1992 |
| JP | 5-74580 | 3/1993 |
| JP | 5-74581 | 3/1993 |
| JP | 632588 | 11/1994 |
| JP | 9-56151 | 2/1997 |
| JP | 10-223381 | 8/1998 |
| JP | 11-31593 | 2/1999 |
| JP | 2001-505358 | 4/2001 |
| WO | 99/12187 | 3/1999 |
| WO | 00/35252 | 6/2000 |

OTHER PUBLICATIONS

English Translation of Taiwan Official Letter issued Aug. 8, 2006.
Japanese Office Action issued Mar. 18, 2008 and English language translation.

* cited by examiner

BASIC HALOGEN CONVERTOR IC

CROSS-REFERENCE TO RELATED APPLICATIONS

The present application is a Divisional Application of Ser. No. 10/443,525 filed May 21, 2003 now U.S. Pat. No. 7,321,201, which application is a continuation under 37 C.F.R. §1.53(b) of prior PCT Application Serial No. PCT/US02/41836, filed Dec. 30, 2002 by PETER GREEN and IULIA RUSU entitled "BASIC HALOGEN CONVERTOR IC," and claims priority of U.S. provisional application No. 60/343,236, filed Dec. 31, 2001 and U.S. provisional application No. 60/398,298, filed Jul. 22, 2002, incorporated by reference.

BACKGROUND OF THE INVENTION

1. Field of the Invention

The present invention relates to an integrated circuit (IC) for driving a halogen lamp.

2. Brief Description of the Related Art

FIG. 1 shows a conventional halogen convertor circuit 10 for driving a halogen lamp (not shown) connected across output leads 12 to a secondary coil of transformer 14. Circuit 10 receives AC power across input leads 16, and functions as a basic bipolar self-resonating circuit, but with limited performance.

Integrated circuits (ICs) have been developed to provide electronic ballast controllers for fluorescent lamps. A conventional ballast IC can, for example, include an oscillating half bridge driver, fault logic that responds to signals indicating fault conditions, and other appropriate circuitry for starting and running a fluorescent lamp. An example is the IR2156 IC sold by International Rectifier Corporation (IR) and described in U.S. Pat. No. 6,211,623, the disclosure of which is incorporated herein by reference in its entirety.

Ballast ICs for fluorescent lamps are not, however, suitable for driving other types of lamps, such as halogen lamps and other lamps with filaments (referred to herein as "filament lamps"). It would be advantageous to provide an IC for driving a filament lamp and, more particularly, a halogen lamp.

SUMMARY OF THE INVENTION

The present invention provides a new lamp driver circuit, preferably implemented in a lamp driver IC, which is suitable for driving filament lamps such as halogen lamps.

The circuit of the present invention addresses several differences between systems for driving filament lamps and fluorescent ballasts. For example, halogen lamps and other filament lamps are resistive loads that do not require preheating and ignition. The DC bus for a filament lamp can be a full wave rectified line with no smoothing. A unity power factor is inherent in typical filament lamp systems. Filament lamps can be dimmed with a triac dimmer, and dimming can be achieved by phase cutting of the AC line. The output to a filament lamp can be an isolated low voltage. Protection is required against output short circuit or overload, and shutdown should be auto-resetting (hiccup mode).

The circuit of an embodiment of the present invention includes a high voltage half-bridge gate driver and a variable frequency oscillator controlled by an internal voltage reference and voltage controlled oscillator (VCO). The circuit provides an output voltage regulator for a halogen converter such as an electronic transformer. The circuit provides an internal oscillator, frequency sweep soft start to reduce lamp filament stress at switch on, auto resetting short circuit protection, auto resetting overload protection, variable frequency output voltage regulation, adaptive dead time (or soft switching) to allow cool running MOSFETs, trailing edge self dimming (or phase cut dimming), regulated voltage output (such as 5V for a micro-controller), internal thermal limiting, frequency modulation or variation over AC mains cycle, micropower startup, automatic restart, latch immunity, and ESD protection. The circuit is preferably implemented in the form of an integrated circuit that provides dimming with an external phase cut dimmer.

The circuit of a second embodiment of the present invention includes a high voltage half-bridge gate driver and a variable frequency oscillator controlled by an internal voltage reference and error amplifier. The circuit provides an output voltage regulator for a halogen converter such as an electronic transformer. The circuit provides an internal oscillator, frequency sweep soft start to reduce lamp filament stress at switch on, auto resetting short circuit protection, auto resetting overload protection, variable frequency output voltage regulation, adaptive dead time (or soft switching) to allow cool running MOSFETs, trailing edge self dimming (or phase cut dimming), regulated voltage output (such as 5V for a microcontroller), internal thermal limiting, frequency modulation or variation over AC mains cycle, micropower startup, automatic restart, latch immunity, and ESD protection. The circuit is preferably implemented in the form of an integrated circuit that is micro-controller compatible, such as with DALI or DMX512, and that also provides dimming with an external phase cut dimmer.

The circuits of the present invention result in longer lamp life and superior product reliability.

Other features and advantages of the present invention will become apparent from the following description of the invention, which refers to the accompanying drawings.

DETAILED DESCRIPTION OF EMBODIMENTS OF THE INVENTION

First Embodiment

Figure 2:
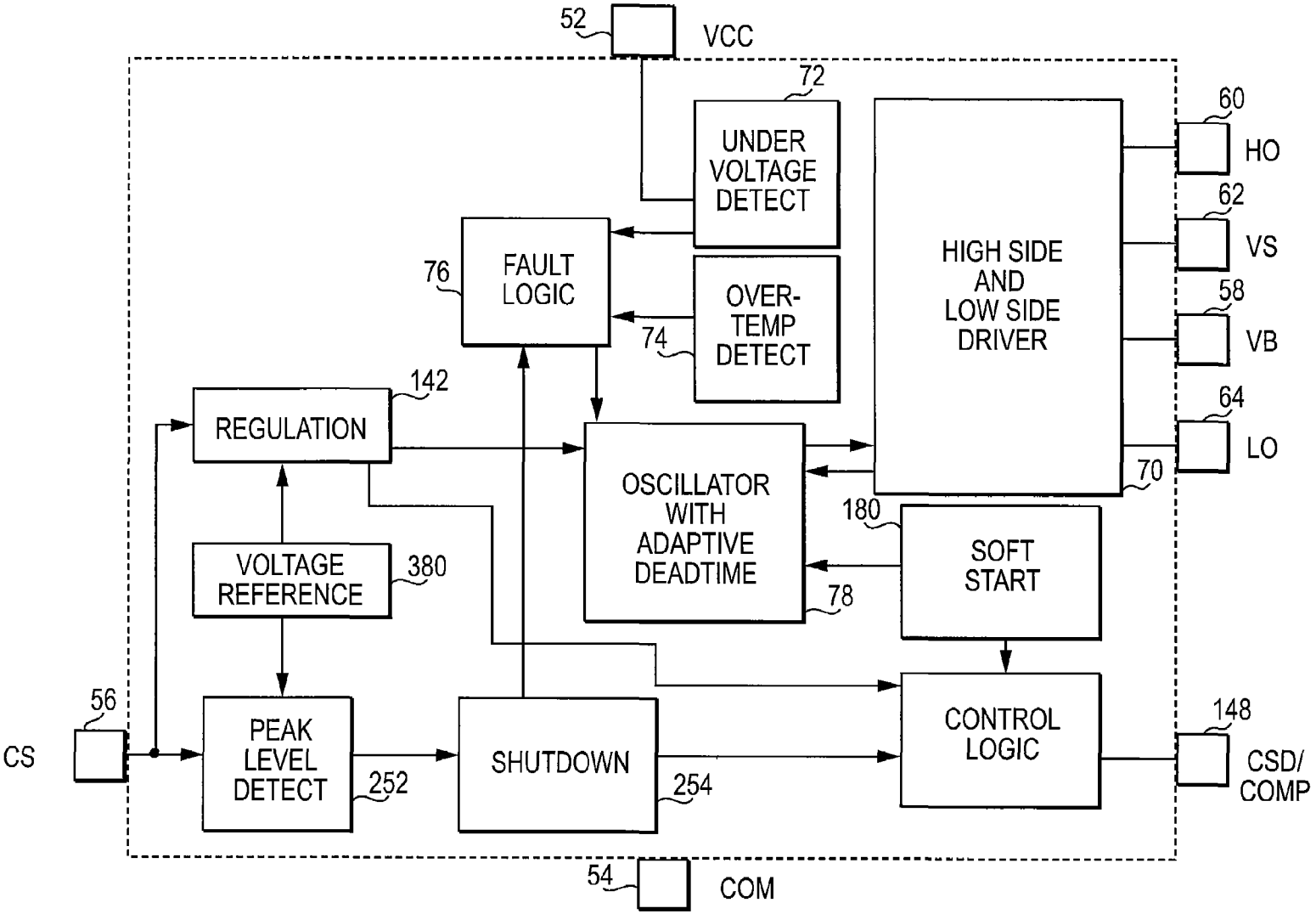
FIG. 2 is a block diagram of an integrated circuit according to a first embodiment of the invention.

FIG. 2 shows the major functional components of an 8 pin integrated circuit (IC) 50, IR part number IR2161, in which the circuit of the present invention is implemented. A more advanced implementation is envisaged in a 14 pin integrated circuit, part number IR2162. The IR2161 will be discussed in detail here and additional functionality included in the IR2162 discussed elsewhere.

Supply voltage (VCC) pin 52, power and signal ground (COM) pin 54, current sensing (CS) pin 56, high-side gate drive floating supply (VB) pin 58, high-side gate driver output (HO) pin 60, high-side floating return (VS) 62, and low-side gate driver output (LO) pin 64 perform substantially the same functions and can be implemented in substantially the same manner as similarly identified pins of the IR2156 IC or the IR2157(1) IC, products of International Rectifier Corporation. Features of the IR2157(1) IC are also described in U.S. Pat. No. 6,211,623, the disclosure of which is incorporated herein in its entirety. Similarly, high side and low side driver 70, under voltage detect circuitry 72, over-temperature detect circuitry 74, and fault logic 76 perform substantially the same functions and can be implemented in substantially the same manner as similarly identified circuitry in U.S. Pat. No. 6,211,623. Oscillator component 78 and other components of IC 50 can be understood from the description below.

Figure 1:
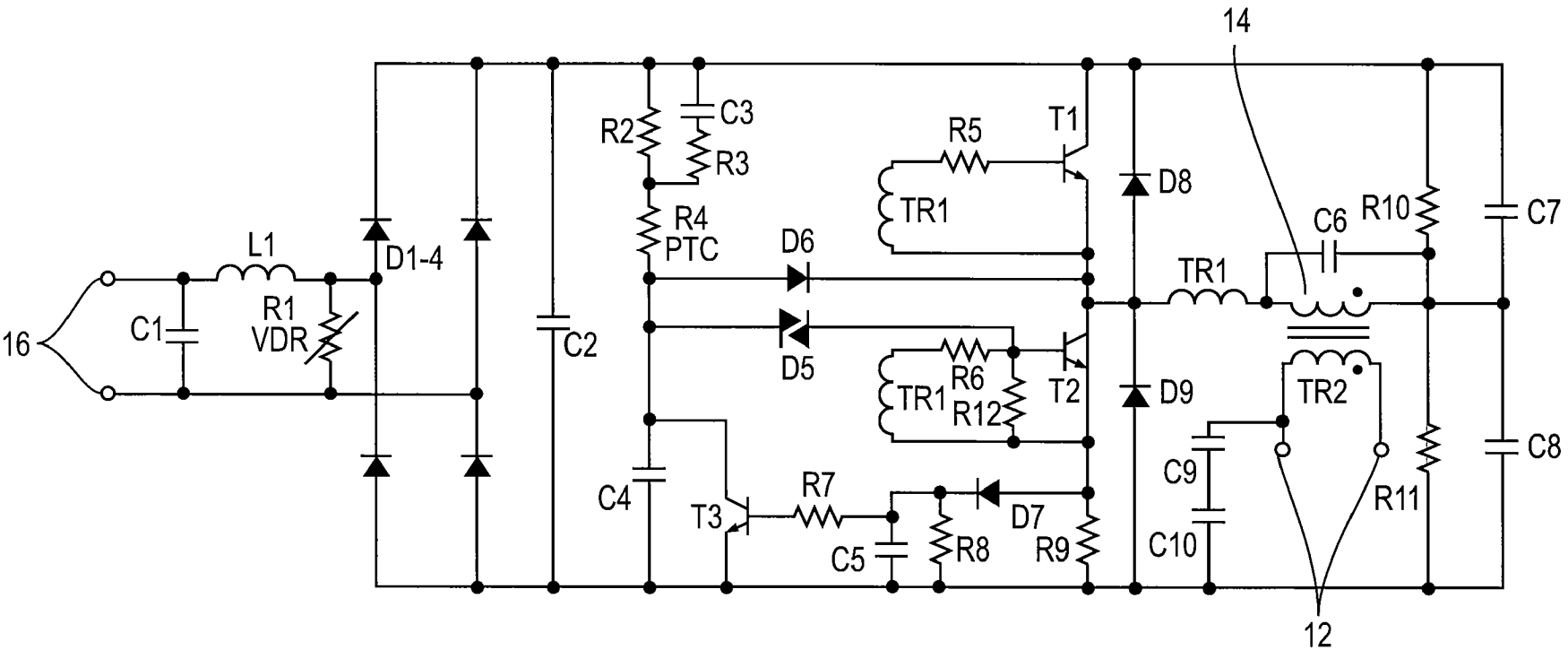
FIG. 1 shows a conventional halogen converter circuit.
Figure 3:
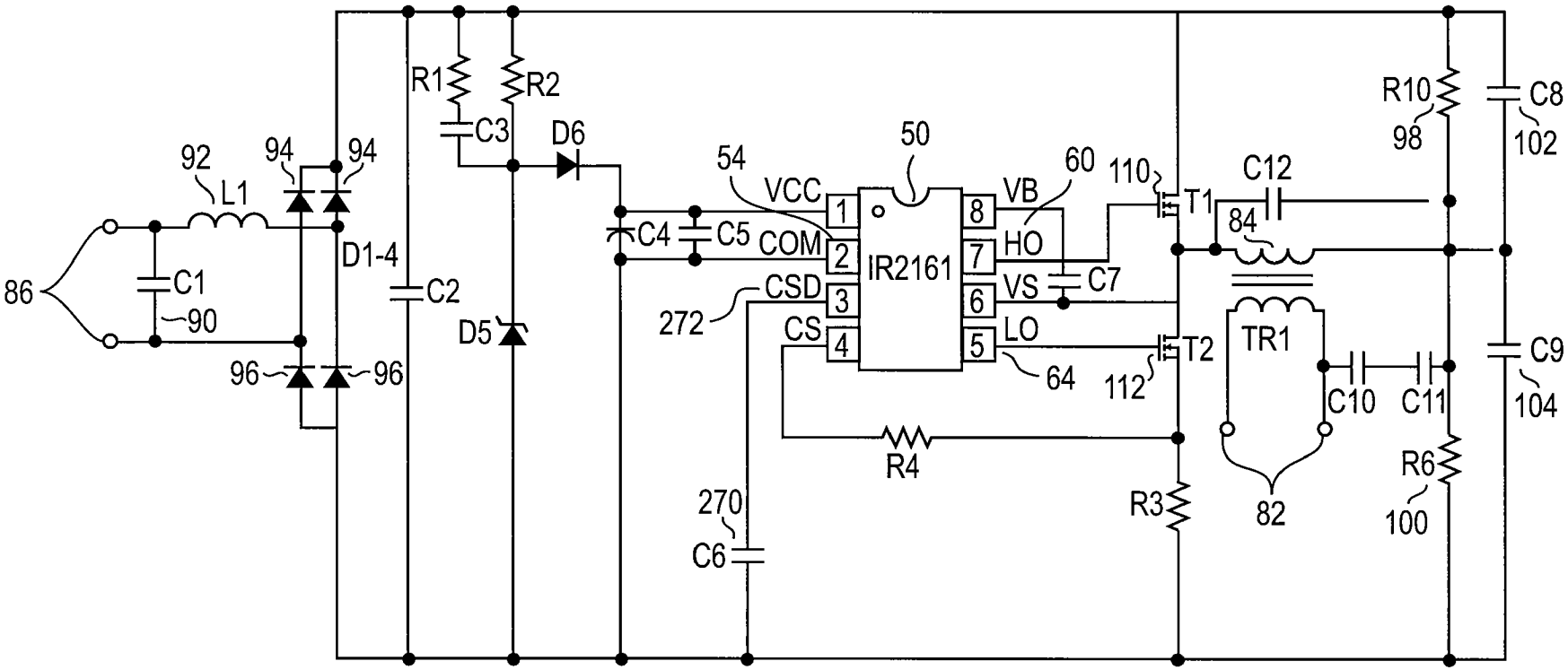
FIG. 3 shows a circuit incorporating the integrated circuit of FIG. 2.

FIG. 3 shows circuit 80 in which the IC 50, implemented as a product of International Rectifier Corporation referred to as the IR2161 IC, is connected to drive a halogen lamp (not shown) connected to output leads 82 through transformer 84, which functions similarly to transformer 14 in FIG. 1. Circuit 80 receives AC power through input leads 86, with capacitance 90, inductance 92, diodes 94 and 96, resistances 98 and 100, and capacitances 102 and 104 performing the same functions as the counterpart components in conventional circuit 10 in FIG. 1. Circuit 80 provides an oscillating signal to transformer 84 through operation of high and low side power MOSFETs 110 and 112. High side MOSFET 110 receives its gate drive signal from driver 70 through HO pin 60, and low side MOSFET 112 receives its gate drive signal from driver 70 through LO pin 64. In this configuration the output voltage varies depending on load due to the load regulation of the output transformer 84, and also the system running frequency. Since the transformer 84 has a primary leakage inductance, the output voltage will drop as the frequency increases.

Oscillator

Figure 4:
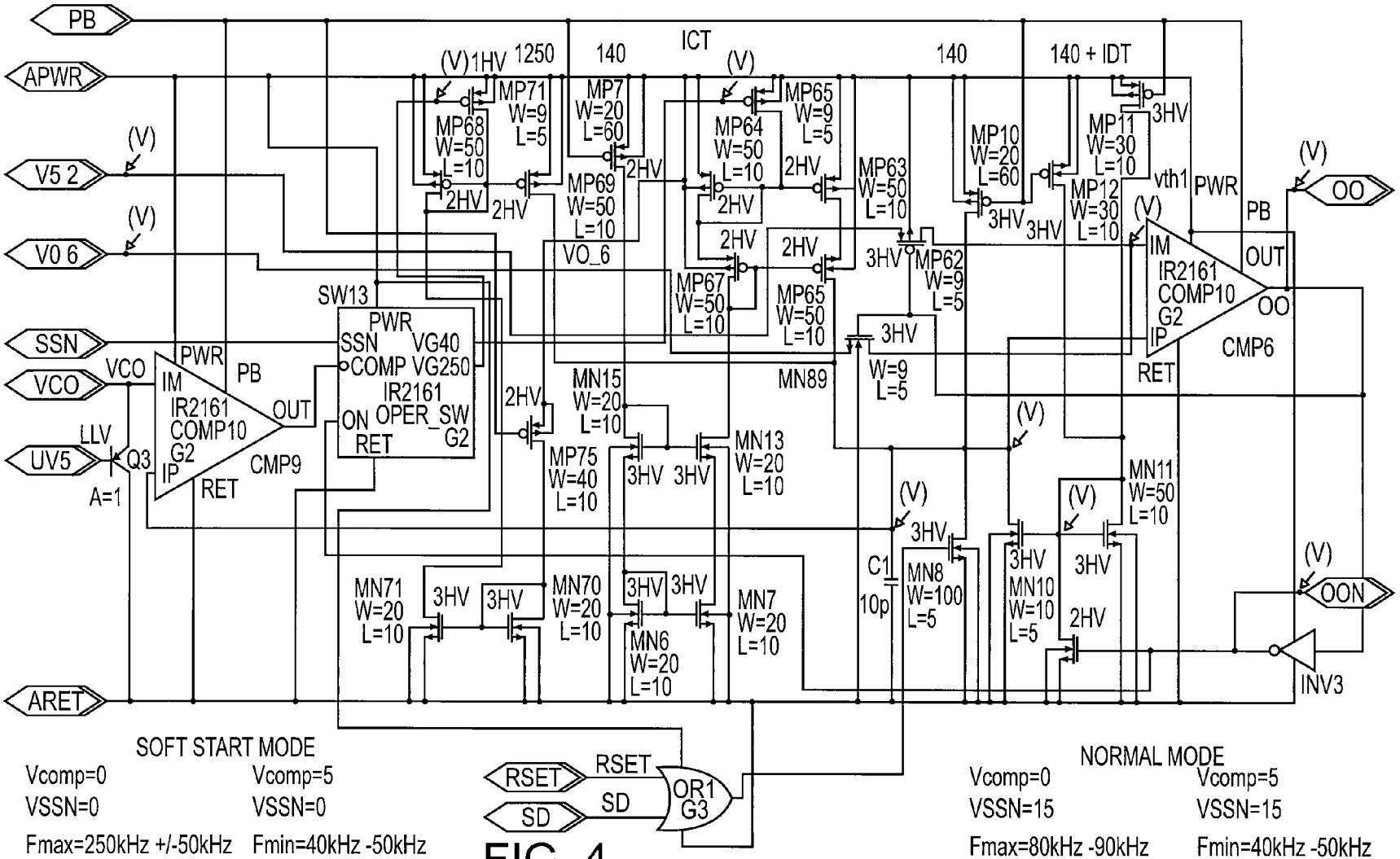
FIG. 4 is a schematic diagram showing the oscillator circuit in FIG. 2.
Figure 10:
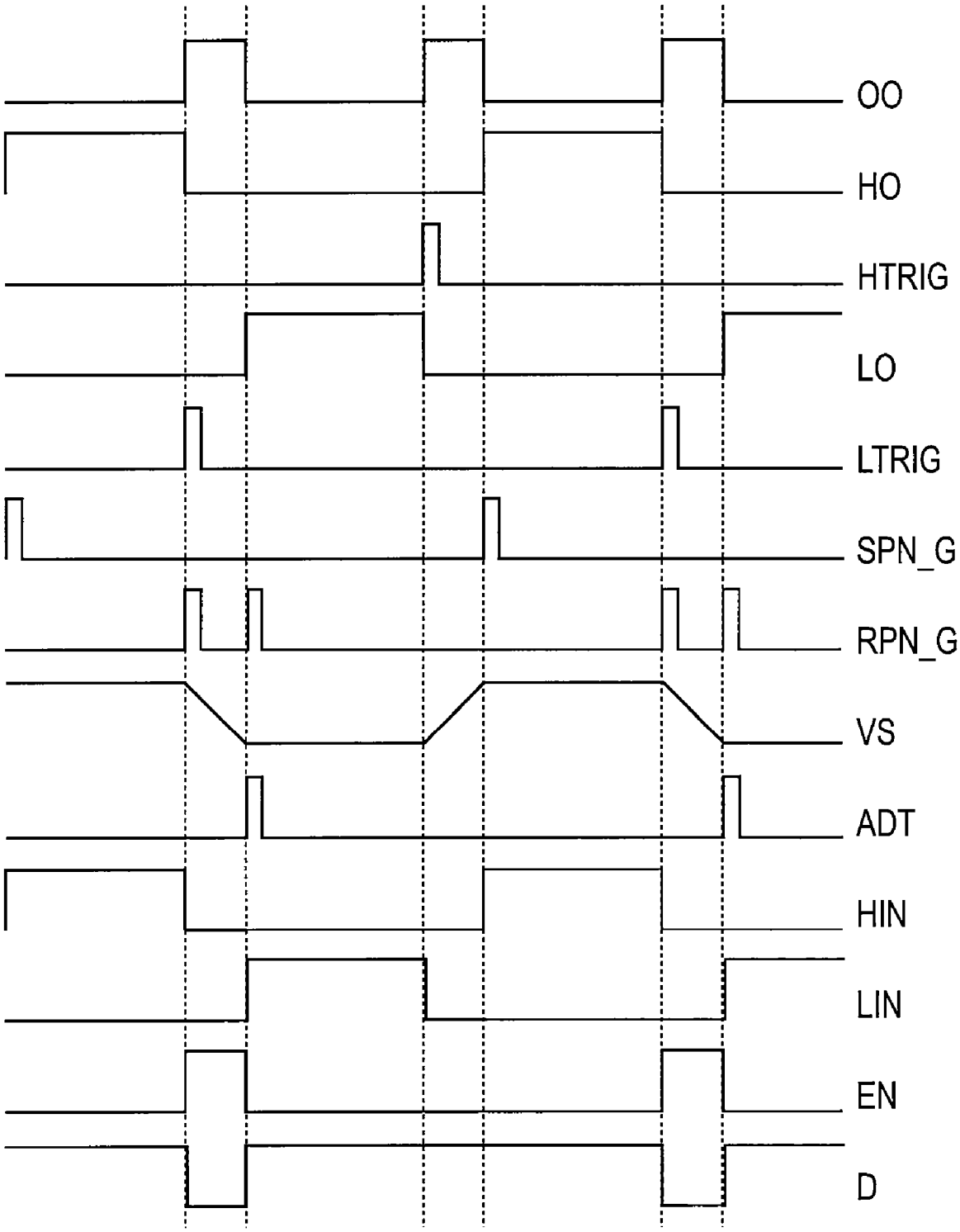
FIG. 10 is a timing diagram showing signals for illustrating the operation of the adaptive dead time circuit.

To implement oscillator component 78 in FIG. 2, oscillator circuitry in FIG. 4 provides an output signal OO to driver 70; this signal is shown in FIG. 10. The output signal includes a series of pulses from the output of comparator CMP 6. The OO signal is high during dead time and low when driver 70 is providing a pulse to either one of MOSFETs 110 and 112.

Referring to FIG. 4, comparator CMP6 provides a high output when capacitance C1, charged by a controlled current source, reaches threshold voltage Vth1. The high output also turns on shunt transistor MN9 to discharge capacitance C1 at a predetermined current. The high output also causes threshold logic to adjust Vth1 by switching on MN89 reducing the threshold from 5V to 0.6V. The comparator output remains high until the voltage on C1 has fallen below 0.6V. The time taken for this to occur determines the dead time in which neither MOSFET 110 or 112 is switched on. C1 may however be instantly discharged to 0V via MN8, immediately causing the comparator output to go low and the next cycle to begin, if a pulse is applied to the RSET input. This pulse will be sent from the adaptive dead time circuit which will be discussed later.

The oscillator circuit is voltage controlled from a DC control voltage in the range 0 to +5V applied at input VCO. The VCO input is connected to the external CSD pin 272 via a transmission gate TGATE_SWITCH1 within the shutdown circuit shown in FIG. 11. This transmission gate will be enabled at all times except during a fault condition detected by the shutdown circuit. The external capacitor 270 connected from pin CSD to COM 54 has three separate operating modes which will be discussed in detail, briefly these are: (1) soft start timing, (2) smoothing the amplified CS pin signal in voltage compensation mode and (3) shutdown and auto-restart timing.

The logic input SSN (soft start not) determines the upper frequency of operation, which occurs when the VCO input is set at 0V. The lower frequency will be the same regardless of the state of SSN. The frequency varies approximately linearly as the VCO voltage changes. The VCO frequency range during soft start, when SSN is high, is greater than during normal running when it operates in voltage compensation mode. The IR2161 determines the load at the convertor output 80 by sensing the current in the MOSFET 110, 112 half bridge via the current sense resistor feeding a voltage into the CS pin 56.

Soft Start

Figure 6:
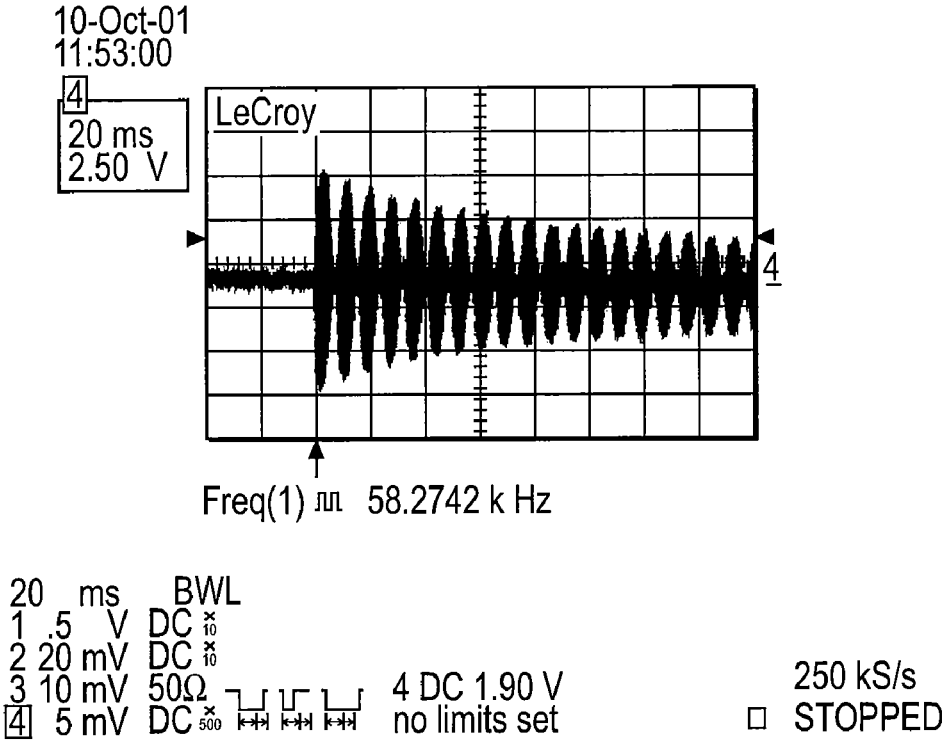
FIGS. 6 and 7 respectively show turn-on lamp current before and after implementation of a soft start circuit.

Soft start will take place when the convertor is first switched on. When the lamp filament is cold it has a lower resistance than when hot, which would result in a high inrush current as shown in FIG. 6. This has been seen to produce a false triggering of the shutdown circuitry in some systems currently in use, resulting in the lamps flashing on and off several times before reaching steady continuous operation.

Figure 5:
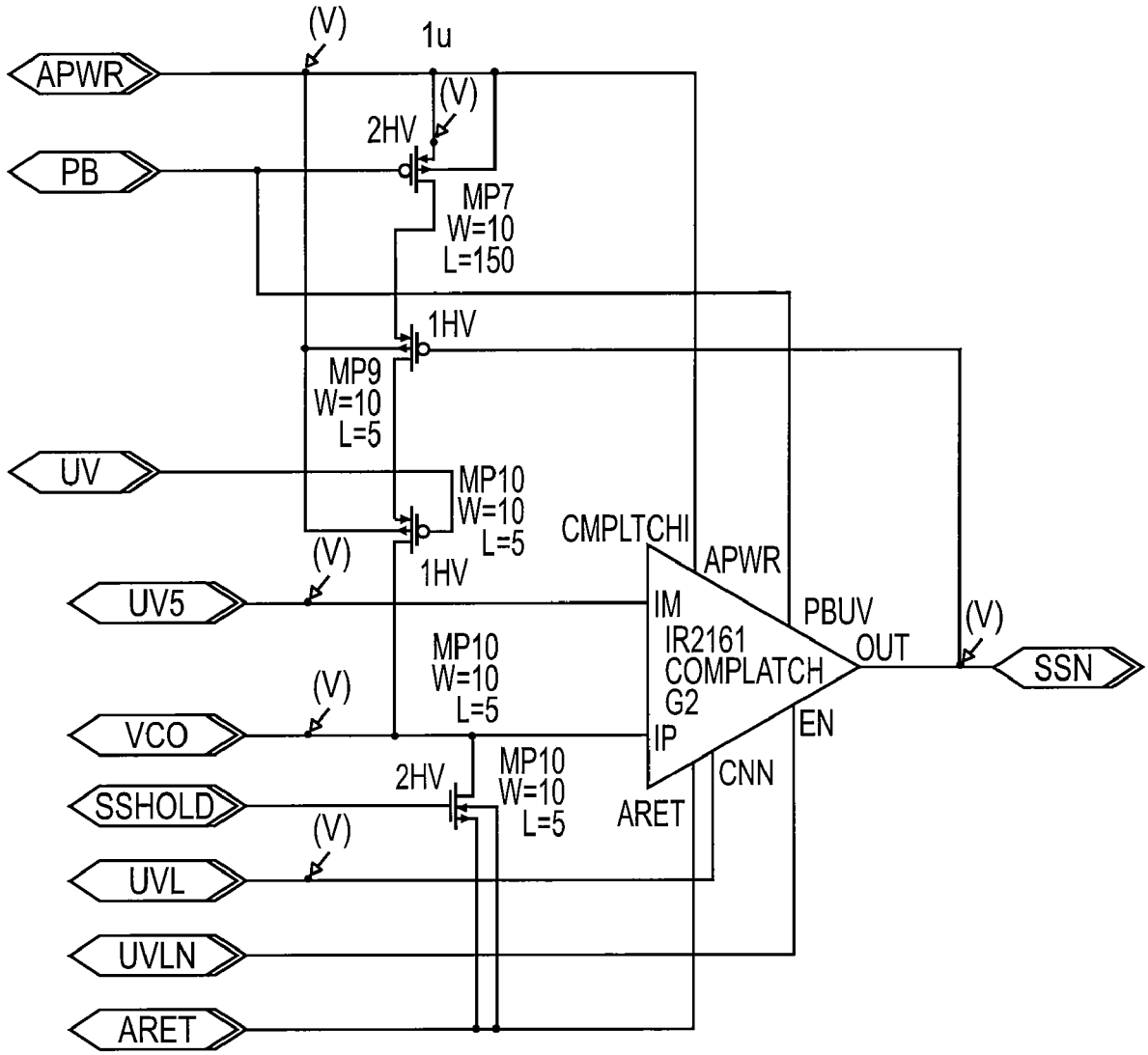
FIG. 5 is a schematic diagram showing the soft start circuit in FIG. 2.
Figure 7:
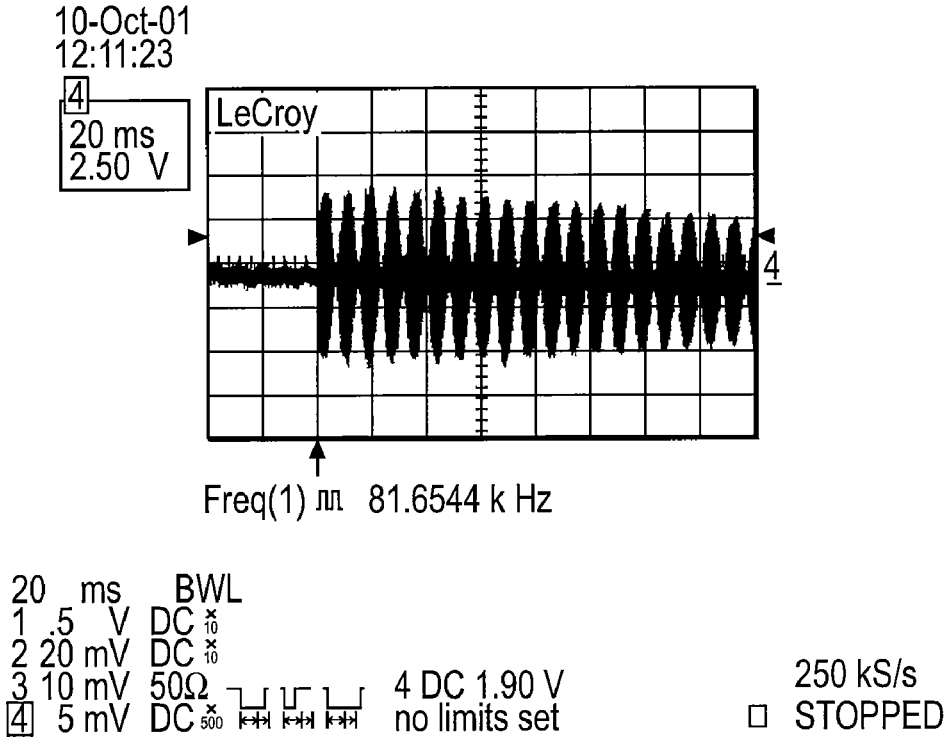

The soft start circuit avoids this problem and at the same time reduces stress on the filament at start up, which may prolong the life of the lamp. The soft start circuit FIG. 5 operates when the VCC pin of the IC 52 is raised above the under voltage lockout (UVLO) threshold. The UVLO function is common with International Rectifier lighting ballast control ICs, such as the IR2156. At this point the oscillator starts at a higher frequency and the external CSD 270 capacitor begins to charge from a current source within the IC that is only enabled during soft start. As the voltage at pin CSD increases, the frequency will fall and as it does so more power will be applied to the lamp. When the voltage at CSD reaches a threshold of 5V, the frequency will have fallen to the minimum at around 30 kHz. The soft start circuit implementation within the IC can be seen in FIG. 5. The output of latching comparator CMPLTCH1 is the SSN logic signal going from low to high at the end of the soft start period, which is fed into the oscillator that determines the frequency range. The effect on the lamp inrush current can be seen in FIG. 7.

Voltage Compensation Mode

Figure 8:
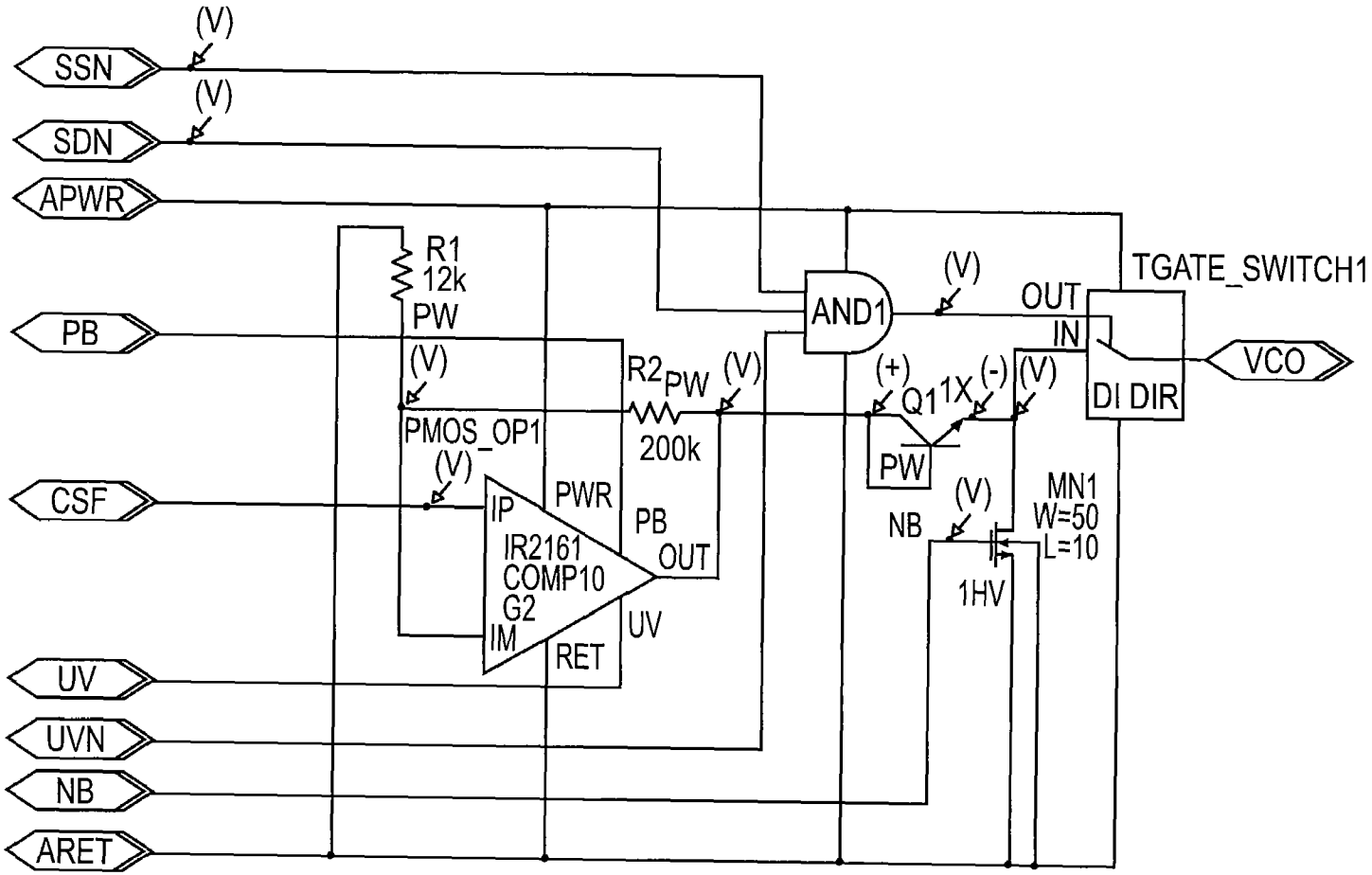
FIG. 8 is a schematic diagram showing a voltage compensation circuit incorporated in the integrated circuit of FIG. 2.

In addition to soft start control, the oscillator frequency can also be controlled in response to output current sensing. The current at the CS pin is fed to the CSF input of the voltage compensation circuit of FIG. 8, optionally via a low pass filter that removes unwanted high frequency noise. The circuit in FIG. 8 incorporates an operational amplifier PMOS_OP1, which has a positive voltage fixed gain. The output is fed via a diode Q1 and a transmission gate TGATE_SWITCH1 to the external CSD capacitor and to the oscillator VCO input. The transmission gate is enabled when the system is not in soft start mode and not in shutdown mode, which is in normal operating mode at which time the voltage compensation function is active. Voltage compensation describes a scheme for compensating for changes in output voltage of the convertor due to variations in load. A halogen convertor has a maximum power rating but may be used with a somewhat lighter load resulting in an increased output voltage. For example a 100 W convertor driving two parallel 50 W lamps may produce an RMS output voltage of 11.5V, but if one lamp is removed or goes open circuit the voltage could increase to 12V. Naturally a higher voltage will produce a higher lamp power, which raises the lamp temperature and reduces its life. At maximum load the voltage on the CSD capacitor will be approximately 5V. The voltage at PMOS_OP1 consists of pulses at the oscillator frequency contained within a full wave rectified sinusoidal envelope, the diode Q1 provides peak rectification and the CSD capacitor provides smoothing to produce a DC level proportional to the peak. If the load is reduced, the CSD capacitor will discharge slowly over many cycles via current source MN1. A fast response is unnecessary in this circuit.

Shutdown Circuit

Figure 11:
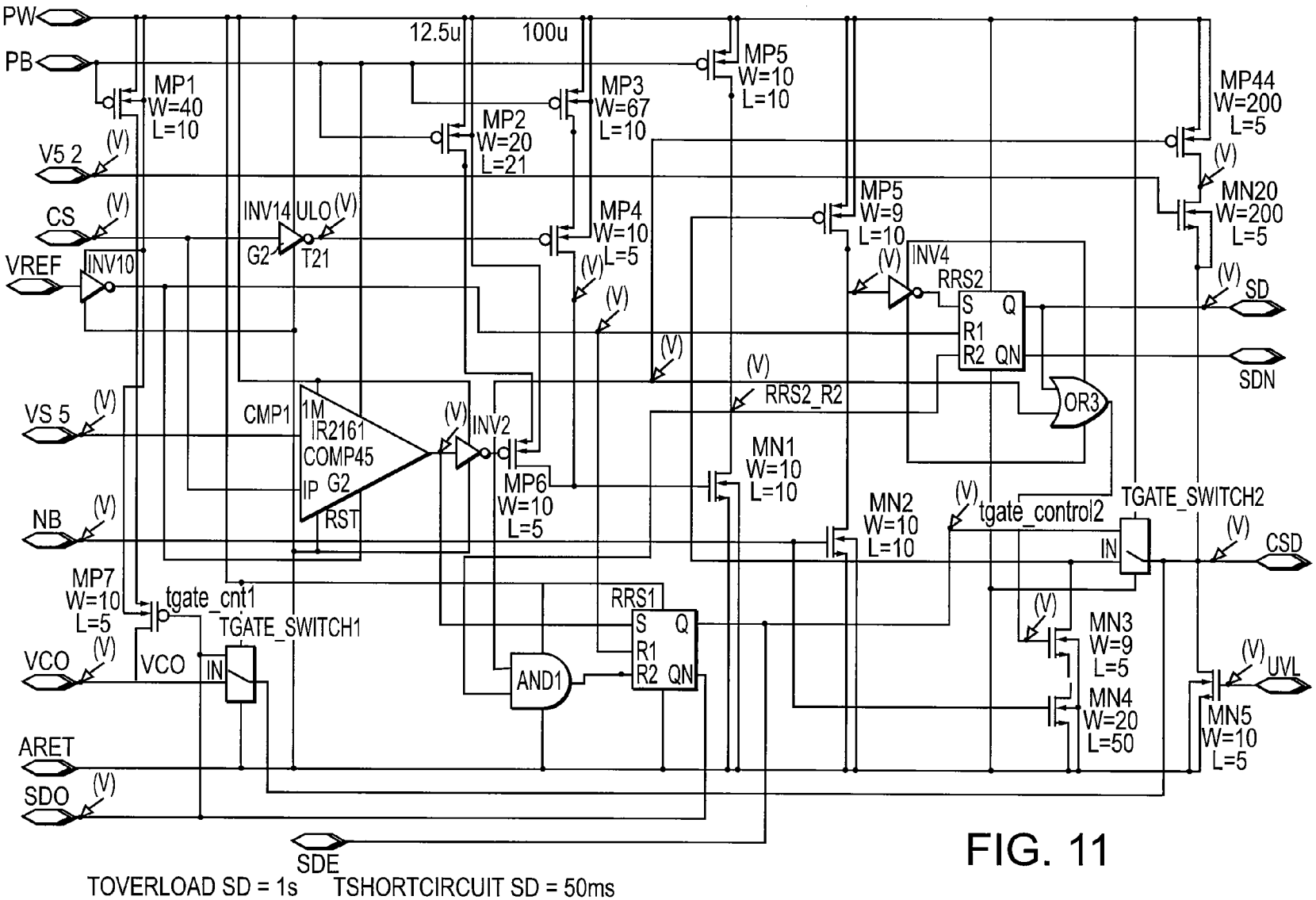
FIG. 11 is a schematic diagram showing the shutdown circuit in FIG. 2.

The shutdown circuit in the IR2161 is shown in FIG. 11. The input CS is connected to the external CS pin of the IC. During normal operation the current sense resistor is selected to provide a peak current of approximately 0.4V at maximum load. This will provide 5V at the CSD pin during voltage compensation mode, which will cause the oscillator to run at minimum frequency as required. If the load is increased to 150% of maximum rating, the peak voltage at the CS pin will consequently reach 0.5V, which will cause the output of CMP1 to go high, switching on MP8 via INV2. Because of the high frequency component of the signal at the CS pin CMP1 will produce high frequency pulses at the peak of the line voltage half cycle. Similarly if a severe overload or short circuit of the output occurs, the peak voltage at CS will exceed the threshold of INV14, which results in its output going low, causing MP4 to switch on.

When CMP1 goes high the flip-flop RRS1 is set. This enables transmission gate TGATE_SWITCH2, connecting the CSD pin to the shutdown circuit; and disables TGATE_SWITCH1, disconnecting the CSD pin from the voltage compensation circuit. At the same time MP44 is switched on causing the CSD capacitor to charge to approximately 4V through MN70 thus ensuring that MN1 is held on, keeping the R2 inputs of RRS1 and RRS2 low. This is to prevent cycle by cycle switching of CSD between the voltage compensation and shutdown circuits.

Figure 14:
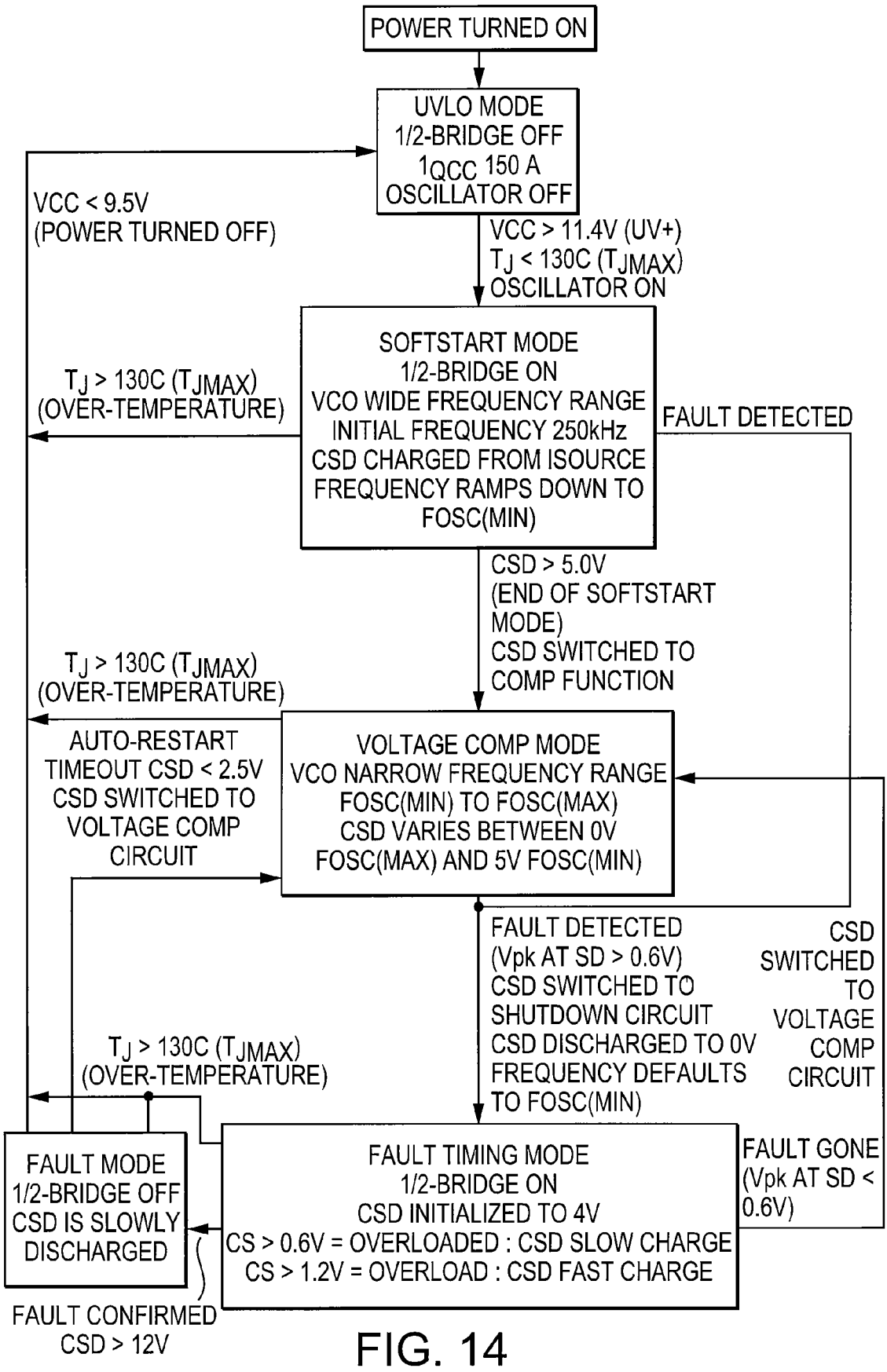
FIG. 14 is a state diagram for illustrating the operation of the shutdown circuit of FIG. 11.

During the period when RRS1 is set, the system is in fault timing mode or fault mode as illustrated in the state diagram shown in FIG. 14. In these modes the voltage compensation circuit, which is clearly not required, becomes inactive and the frequency remains static. When INV14 output is low, current is sourced into the external CSD capacitor 270 via MP3 and MP4 and when CMP1 is high, current is sourced into the capacitor via MP2 and MP8. The rates of charge differ such that INV14 will cause the capacitor to charge far more rapidly than CMP1, since INV14 detects a very high half bridge current that would destroy the external power MOSFETs 110 and 112 within a short time. CMP1 charges the capacitor slowly as the MOSFETs would be able to sustain this current for some time without damage. As the CSD voltage increases to a point close to VCC (referred to within the IC as APWR) the PMOS device MP6 switches off and the input of INV4 goes from high to low, pulled down by MN2. The output of INV4 sets flip-flop RRS2 causing the SD logic signal to go high. When this signal is high the system is disabled with both half bridge MOSFETs are off, removing power to the output completely. Consequently the current at the CS pin falls to zero and INV14 output goes high and CMP1 output goes low, however RRS1 and RRS2 remain set and the system remains in fault mode. In fault mode, MN3 is switched on and discharges CSD through current sink MN4 causing the voltage to gradually drop. When it falls close to zero, MN1 switches off and the R2 input of RRS2 is pulled high via MP6 setting SD low again and thus allowing the oscillator to start running again and the output drives to the MOSFETs to be activated. SDN goes high at the same time and resets flip-flop RRS1 if the output of INV2 is high through AND1. The output of INV2 will be high when there is on over-current fault detected at CS. When RRS1 is reset TGATE_SWITCH2 is disabled and TGATE_SWITCH1 is enabled thus connecting CSD to the voltage compensation circuit and disconnecting from the shutdown circuit. If the oscillator restarts and the fault is still present, the whole sequence will repeat until the fault condition is no longer present. This is illustrated in the state diagram of FIG. 14.

Figure 12:
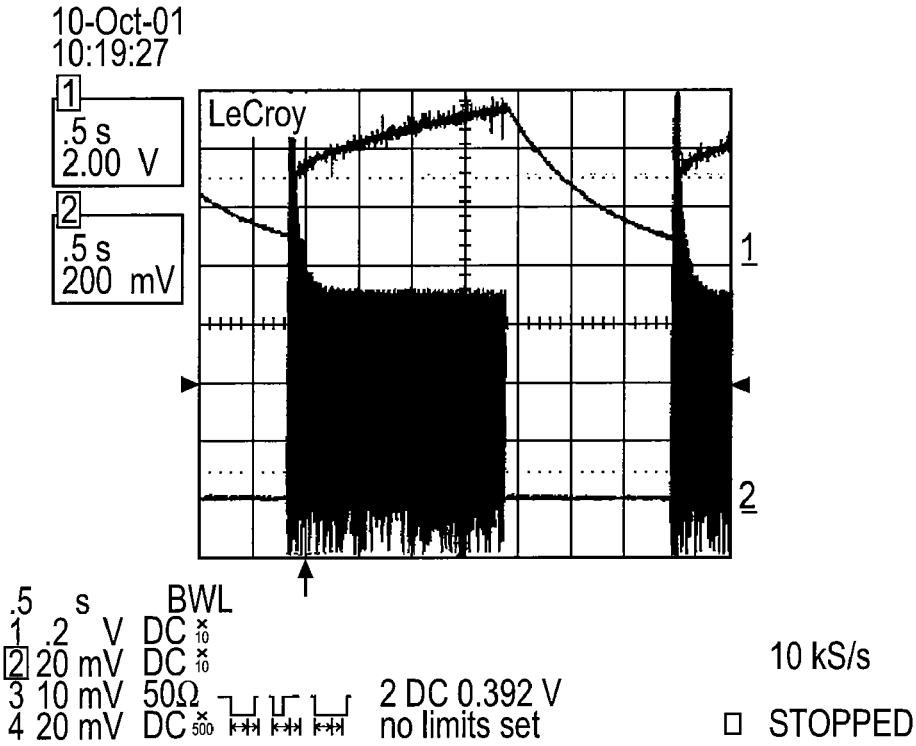
FIGS. 12 and 13 are diagrams showing signals for illustrating overload operation and short circuit operation, respectively, of the shutdown circuit of FIG. 11.
Figure 13:
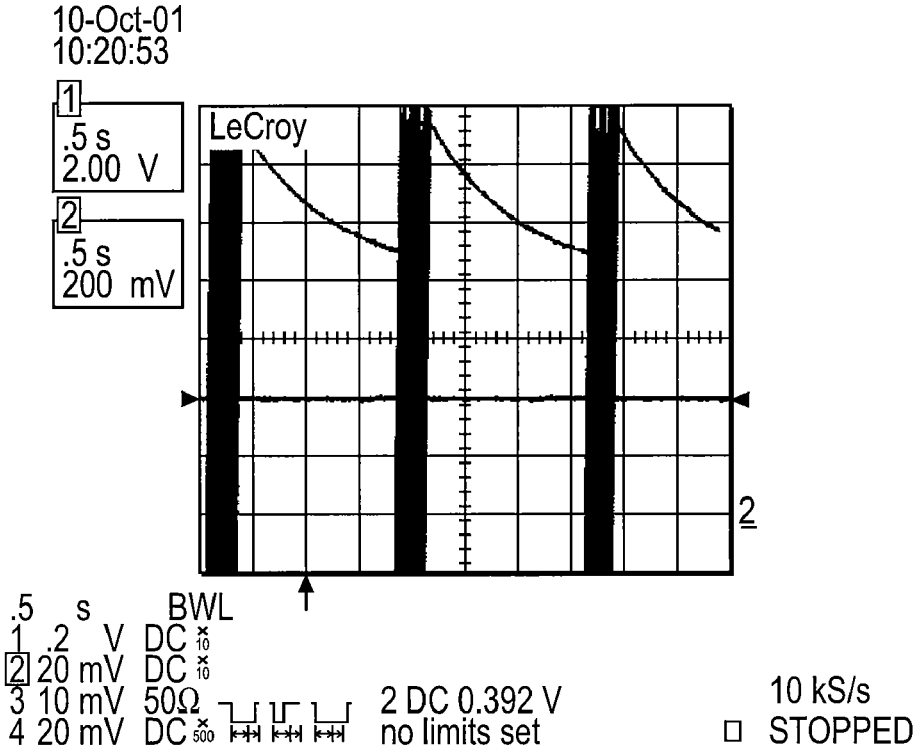

To summarize, if an overload occurs then the system will shut down after a delay of approximately 0.5 seconds. If a short circuit occurs the system will shut down after a delay of approximately 50 mS. In both cases the system will remain off for approximately 0.5 seconds and then restart automatically. If the overload or short circuit condition remains, then the sequence will repeat continuously. This is illustrated in FIG. 12, and FIG. 13. In this way the convertor may tolerate a fault condition indefinitely without overheating or component damage.

Adaptive Dead Time

A self-oscillating halogen convertor based on bipolar power transistors will be inherently efficient because the system will always be soft switching. As the DC bus varies during the line voltage half cycle, the dead time will naturally vary. In order to achieve a similar level of efficiency, the dead time will also adjust in the present system to provide similar soft switching.

The IR2161 includes an adaptive dead time function, which operates by sensing the voltage at the MOSFET half-bridge mid point at the VS pin FIG. 3. When the high side MOSFET 110 is switched off the voltage at VS will slew to 0V due to the leakage inductance of transformer 84 and the drain to source capacitances of the MOSFETs 110 and 112. When the voltage VS reaches 0V it is the correct time for the lower MOSFET 112 to switch on.

Figure 15:
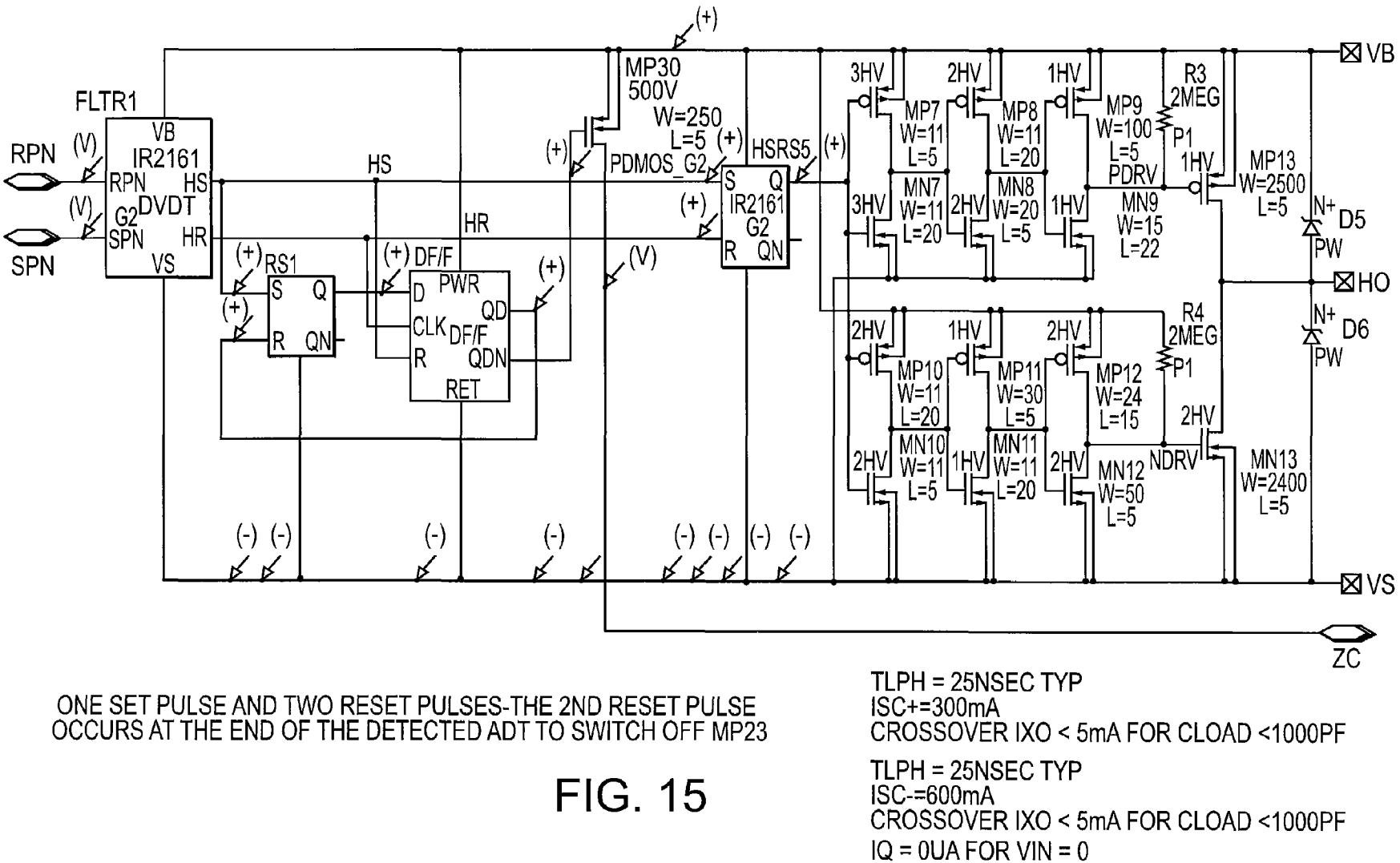
FIGS. 15, 16 and 17 show respectively a high side driver, a PGEN circuit and an output logic circuit associated with the adaptive dead time circuit.

The high side driver output HO that drives the gate of MOSFET 110 is set high by a negative going pulse fed to the SPN input of the circuit shown in FIG. 15. It is set low with a negative going pulse fed to the RPN input. The SPN pulse sets flip-flop RS1 and resets D type flip-flop DF1 causing MP30 to be switched off. The RPN pulse causes the QDN output of DF1 to go low switching on MP30 at the same time as HO is set low at the beginning of the high to low transition of VS. When MP30 is switched on, current is sourced to ZC from the VB pin, which is at the potential of VS plus VCC. Current will flow in the mirror of MN37 and MN38, shown in FIG. 15, which is enabled at this time as HIN is low. This causes the drain of MN38, signal D shown in FIG. 10, to be low. As the VS voltage slews towards zero, a point is reached where there is no more current in the mirror and the drain of MN38 goes high. At this point, a pulse is generated at output ADT, which is shown in FIG. 10. The ADT pulse is fed into OR4, which drives MN31 which will produce a second negative going pulse at the RPN input of the high side driver circuit FIG. 15. This will have no effect on HSRS5 as it is already reset; however it will reset DF1 because the RS1 was reset when DF1 was set. This logic will switch off MP30 and no more current will be supplied to ZC. The result is that MP30, which has been dimensioned to source only a limited current, is switched on only during the high to low slew time of VS.

Figure 9:
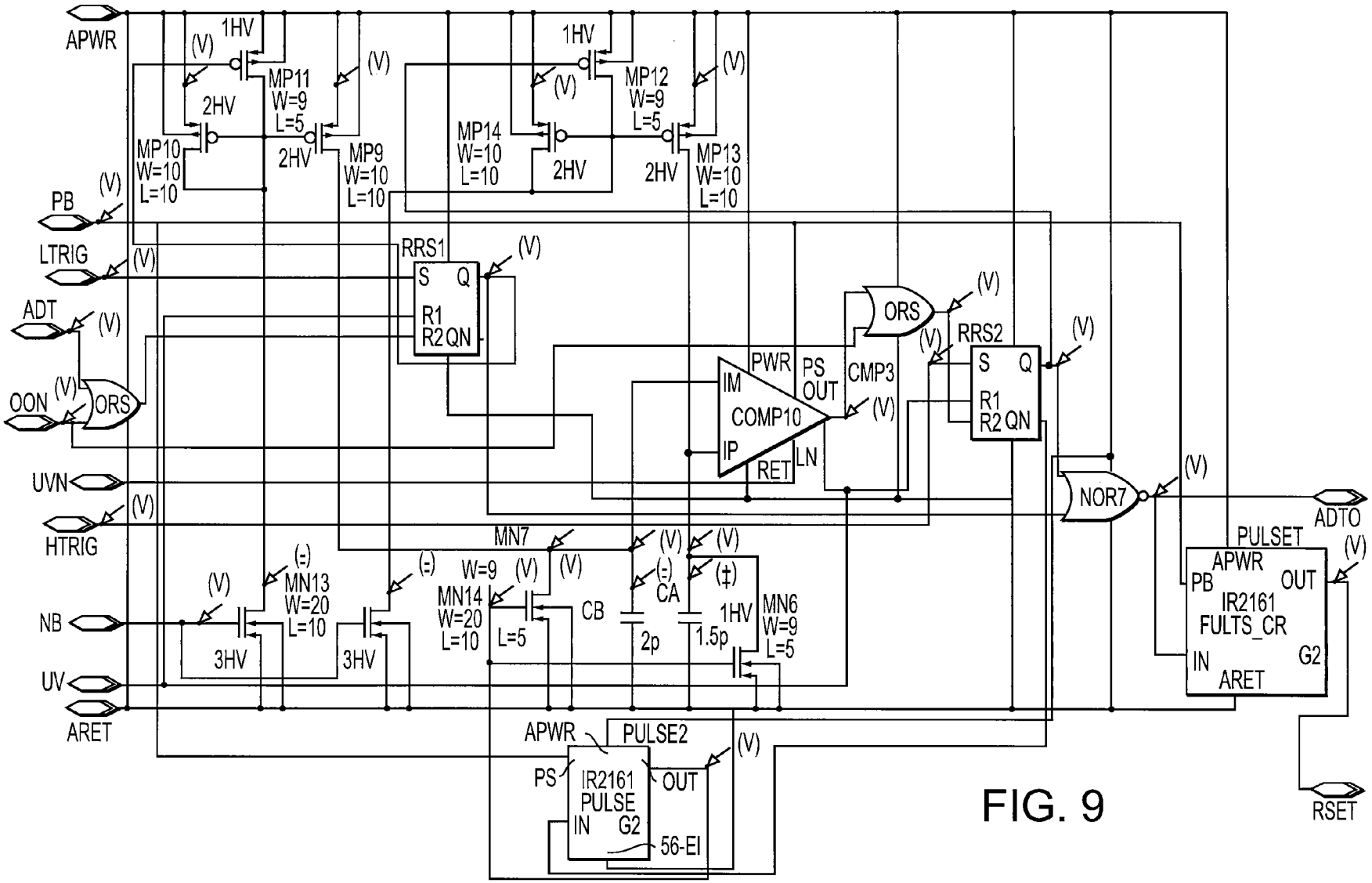
FIG. 9 is a schematic diagram showing an adaptive dead time circuit in the IC of FIG. 2.
Figure 16:
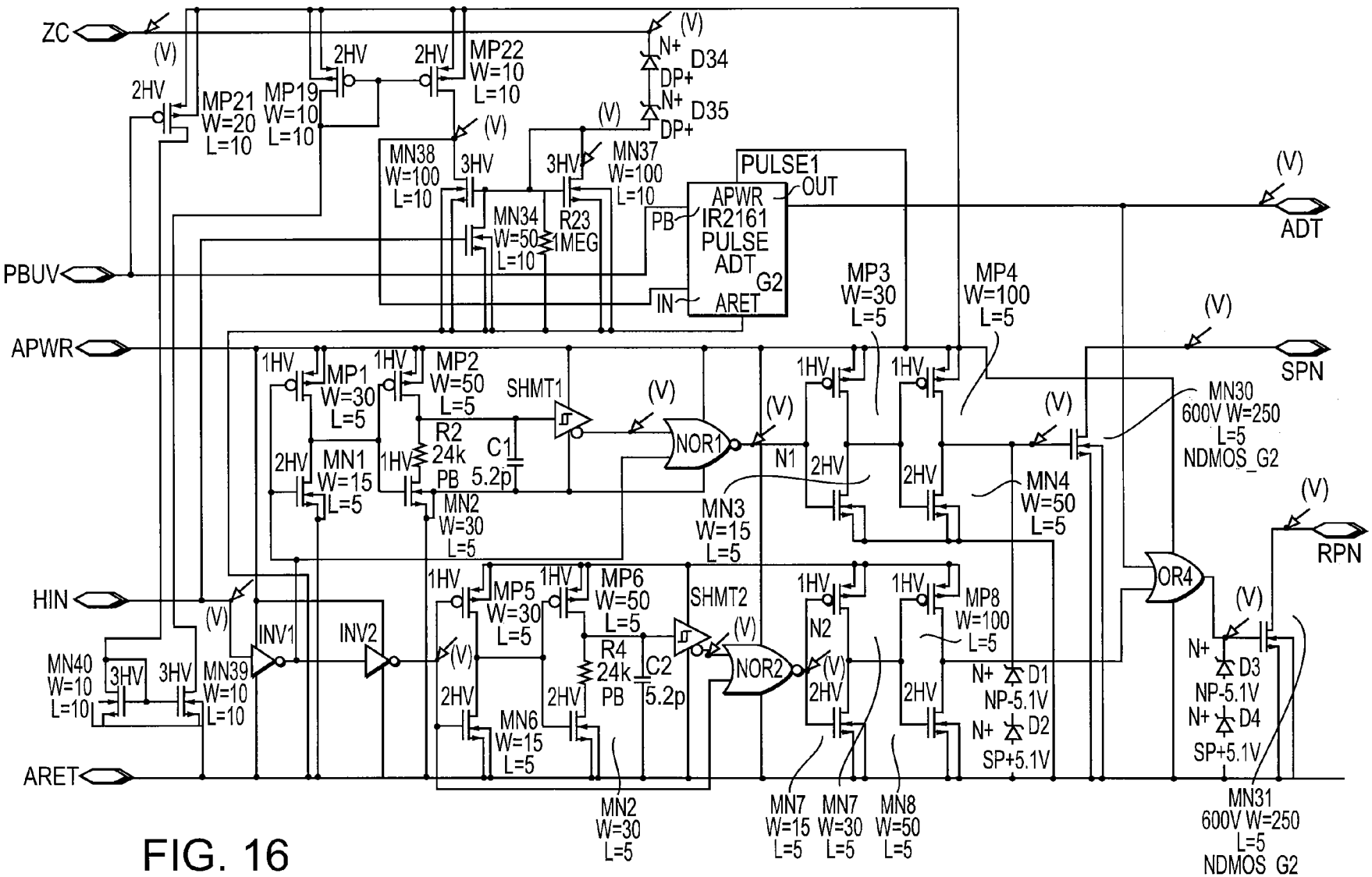

The waveform VS is shown in FIG. 10, which also shows the pulses that feed the gates of MN30 and MN31 of FIG. 16, which produce the SPN and RPN inputs for FIG. 15. Referring to FIG. 10, it can be seen that a pulse occurs at LTRIG at the beginning of the high to low transition of VS and a pulse occurs at ADT when the voltage at VS slew close to 0V. The period between these pulses will determine the dead time. These signals are fed into the adaptive dead time circuit of FIG. 9. RRS1 is set by LTRIG and reset by ADT or OON from the oscillator if for some reason a high to low transition is not detected defaulting the system to a fixed dead time. When RRS1 is set causing MP11 to switch off and the current mirror made up of MP9 and MP10 to source current to capacitor CB. Consequently a voltage will be present on CB proportional to the detected high to low slew time of VS.

Figure 17:
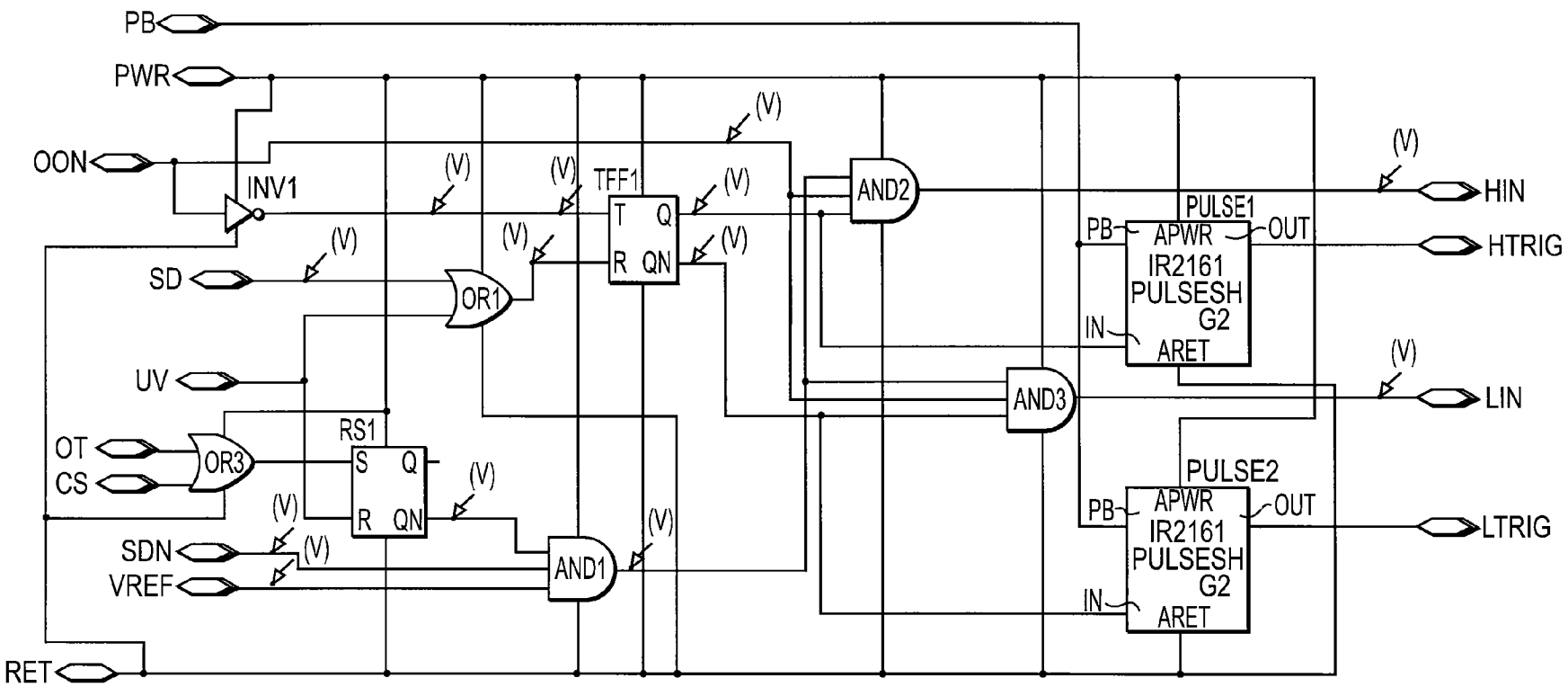

Since it is not possible to sense the low to high slew time in the same way, the system determines the correct dead time by reproducing the high to low slew time, which can be assumed to be similar. When the gate drive to MOSFET 112, LO goes low, the HTRIG pulse occurs which sets flip-flop RRS2, shown in FIG. 9. At this point another identical current source made up of MP13 and MP14 is enabled and CB begins to charge. When the voltage on CA exceeds the voltage on CB the output of comparator CMP3 will go high, thus the slew time is duplicated. When the output of CMP3 goes high, flip-flop RRS2 is reset, therefore the correct dead time pulse is produced for the low to high transition at the Q output of RRS2. The Q outputs from flip-flops RRS1 and RRS2 are fed into the NOR gate NOR7 to produce the ADTO output which consists of a signal that is low during either dead time and high when either output MOSFET 110 or 112 is switched on. The ADTO signal produces a pulse at the RSET output at the end of each dead time, which is fed back to the oscillator of FIG. 4, to discharge C1 and begin the next cycle. In this way the oscillator output OO, shown in FIG. 10, will follow the adaptive dead time circuit and can be inverted and then fed to the output logic circuit shown in FIG. 17, via signal OON which provides blanking of LO and HO via the AND gates, AND2 and AND3.

Phase Cut Dimming Operation

A halogen convertor may be operated through a triac or transistor based phase cut dimming system mainly because of the un-smoothed DC bus voltage. In the case of the IR2161 it has been considered that during the periods when the triac or transistor in the dimmer is off the DC bus voltage will fall to zero. This may result in the voltage at VCC falling below the UVLO negative going threshold since current will continue to be drawn. In order to avoid the possibility of the soft start circuit being re-triggered every half cycle during phase cut dimming operation, a second negative going threshold has been added to the under voltage lockout circuit such that VCC must fall below this lower threshold in order for the soft start circuit to become reset. This second threshold is approximately 2V below the first. When VCC falls below the first threshold the IC will go into micro power mode and draw only a very small current from the VCC capacitor. It will therefore take longer than one line voltage half cycle for this capacitor at VCC to discharge by a further 2V and consequently the soft start circuit will not be reset.

Additional Functions

The IR2161 has additional functions (such as over temperature shutdown) which are also implemented in other ICs produced by International Rectifier, such as the IR2157(1).

Second Embodiment

Figure 18:
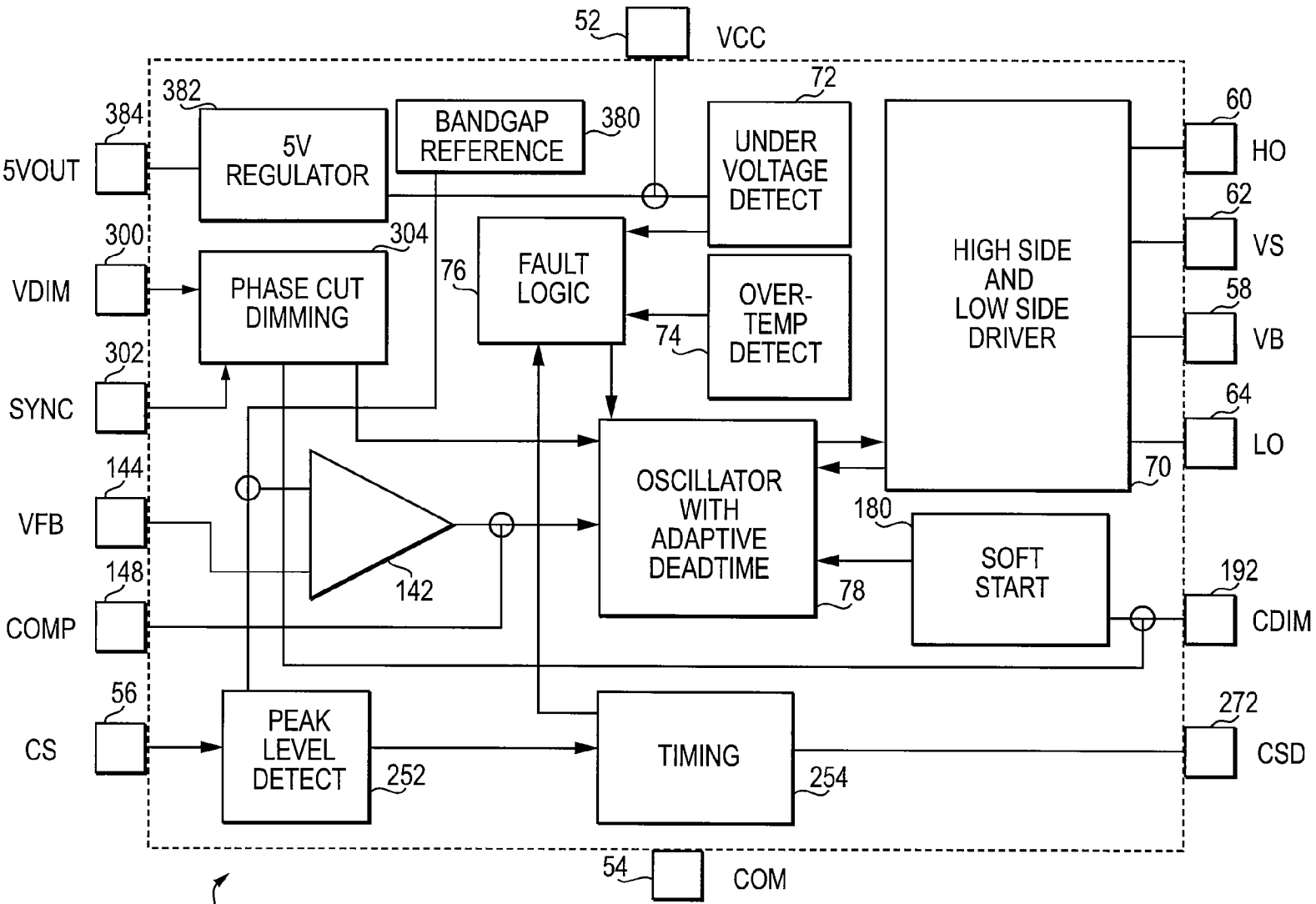
FIG. 18 is a block diagram of an IC according to a second embodiment of the invention.

FIG. 18 shows the major functional components of a second embodiment of an integrated circuit (IC) 50 in which the circuit of the present invention is implemented. Supply voltage (VCC) pin 52, power and signal ground (COM) pin 54, current sensing (CS) pin 56, high-side gate drive floating supply (VB) pin 58, high-side gate driver output (HO) pin 60, high-side floating return (VS) 62, and low-side gate driver output (LO) pin 64 perform substantially the same functions and can be implemented in substantially the same manner as similarly identified pins of the IR2156 IC or the IR2157 IC, products of International Rectifier Corporation. Features of the IR2157 IC are also described in U.S. Pat. No. 6,211,623, the disclosure of which is incorporated herein in its entirety. Similarly, high side and low side driver 70, under voltage detect circuitry 72, over-temperature detect circuitry 74, and fault logic 76 perform substantially the same functions and can be implemented in substantially the same manner as similarly identified circuitry in U.S. Pat. No. 6,211,623. Oscillator component 78 and other components of IC 50 can be understood from the description below.

Figure 19:
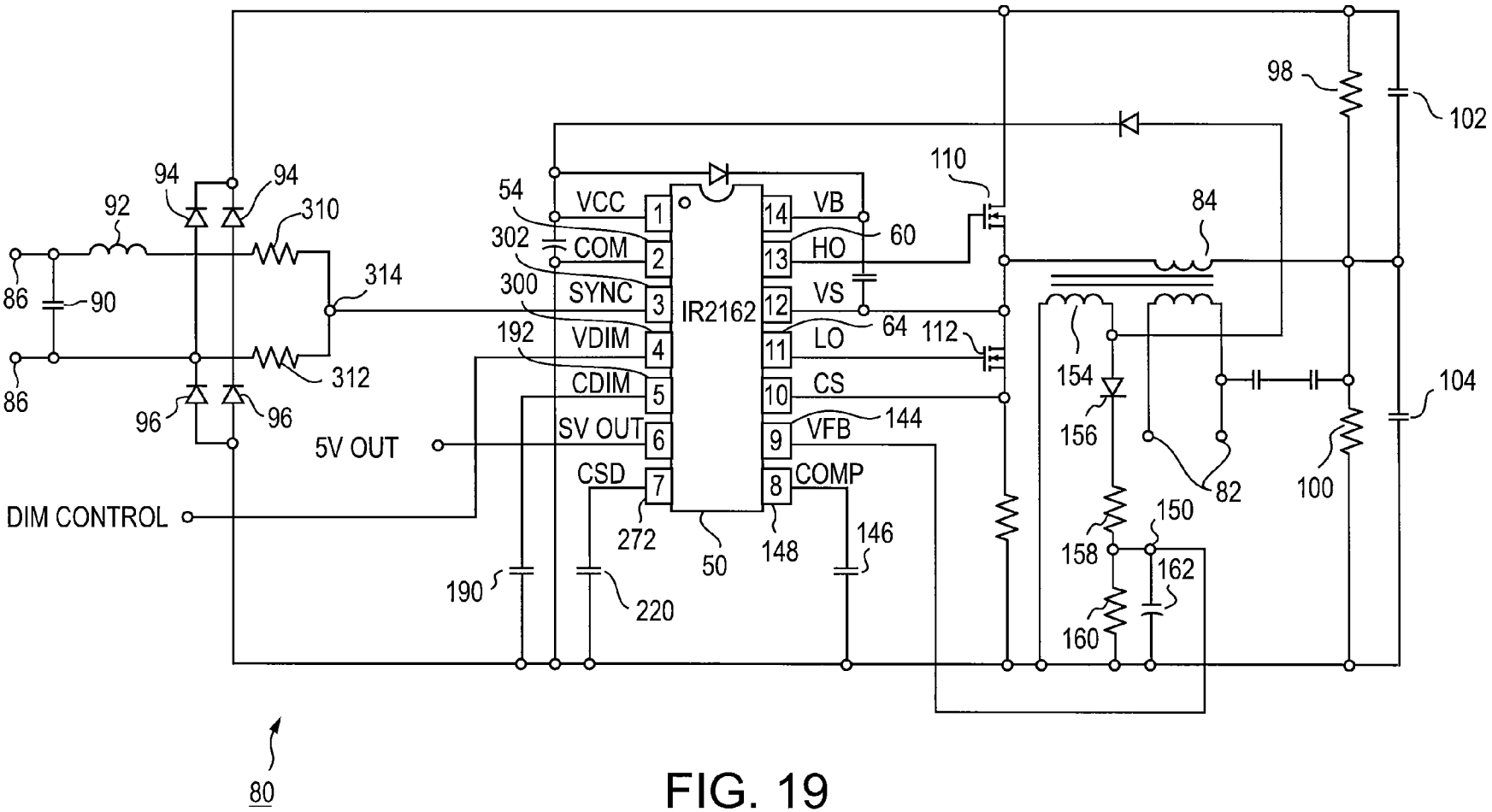
FIG. 19 shows a halogen converter circuit which incorporates the IC of FIG. 18.

FIG. 19 shows circuit 80 in which IC 50, implemented as a product of International Rectifier Corporation referred to as IR2162 IC, is connected to drive a halogen lamp (not shown) connected to output leads 82 through transformer 84, which functions similarly to transformer 14 in FIG. 1. Circuit 80 receives AC power through input leads 86, with capacitance 90, inductance 92, diodes 94 and 96, resistances 98 and 100, and capacitances 102 and 104 performing the same functions as the counterpart components in conventional circuit 10 in FIG. 1. Circuit 80 provides an oscillating signal to transformer 84 through operation of high and low side power MOSFETs 110 and 112. High side MOSFET 110 receives its gate drive signal from driver 70 through HO pin 60, and low side MOSFET 112 receives its gate drive signal from driver 70 through LO pin 64.

Figure 20:
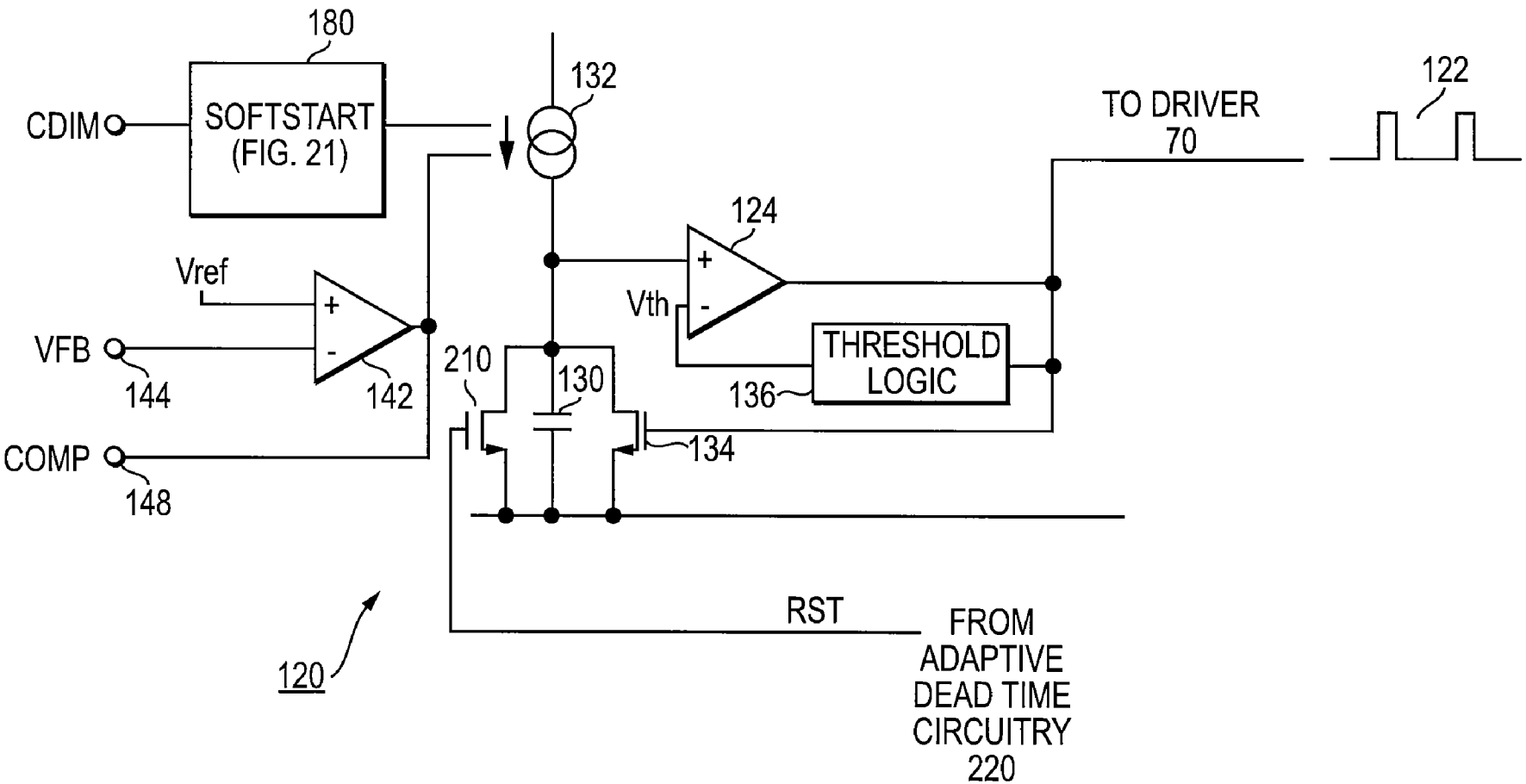
FIG. 20 shows an oscillator circuit in the IC of FIG. 18.

To implement oscillator component 78 in FIG. 18, oscillator circuitry 120 in FIG. 20 provides an output signal OSC to driver 70. Output waveform 122 illustrates that the output signal includes a series of pulses from the output of comparator 124. The OSC signal is high during dead time and low when driver 70 is providing a pulse to either one of MOSFETs 110 and 112.

Comparator 124 provides a high output when capacitance 130, charged by controlled current source 132, reaches threshold voltage Vth. The high output also turns on shunt transistor 134 to discharge capacitance 130. The high output also causes threshold logic 136 to adjust Vth to ensure that comparator 124 goes low and then high again at appropriate times.

Controlled current source 132 is controlled in several ways, including control by feedback voltage and control during soft start. Changing the rate at which current source 132 charges capacitance 130 in turn changes the frequency of oscillation. Rates of charging by current source 132 therefore have counterpart frequency ranges.

For feedback voltage control, the rate at which current source 132 charges capacitance 130 is controlled by output from comparator 142. For example, current source 132 can have a minimum current level that ensures a minimum frequency of output waveform 122, such as 40 Khz. But when the feedback voltage at charge pump input (VFB) pin 144 exceeds a bandgap reference voltage Vref, comparator 142 charges external capacitance 146 through error amplifier compensation (COMP) pin 148, causing the voltage to current source 132 to rise and the charging rate of capacitance 130 to increase, thus increasing the frequency of output waveform 122. The rate of increase is determined by the size of capacitance 146.

As shown in FIG. 19, VFB pin 144 is connected to receive a voltage from node 150, which is connected to indicate the signal provided to the halogen lamp through output leads 82. Transformer 84 has additional secondary coil 154, one lead of which is connected to ground through diode 156, resistances 158 and 160, and capacitance 162 connected across resistance 160. When coil 154 begins receiving a signal in the conductive direction of diode 156, current through resistance 158 initially charges capacitance 162, increasing voltage at node 150 and producing current through resistance 160. When the signal changes to the non-conductive direction of diode 156, current through resistance 158 stops and capacitance 162 discharges through resistance 160, allowing voltage at node 150 to drop. As a result, the voltage at VFB pin 144 will exceed Vref during a part of each cycle of the output signal.

The size of capacitance 146 thus determines the output signal frequency: If capacitance 146 is large, current source 132 charges capacitance 130 at approximately the rate for the minimum frequency; but if a smaller capacitance 146 is chosen, current source 132 charges capacitance 130 at a faster rate, producing a higher output signal frequency.

Figure 21:
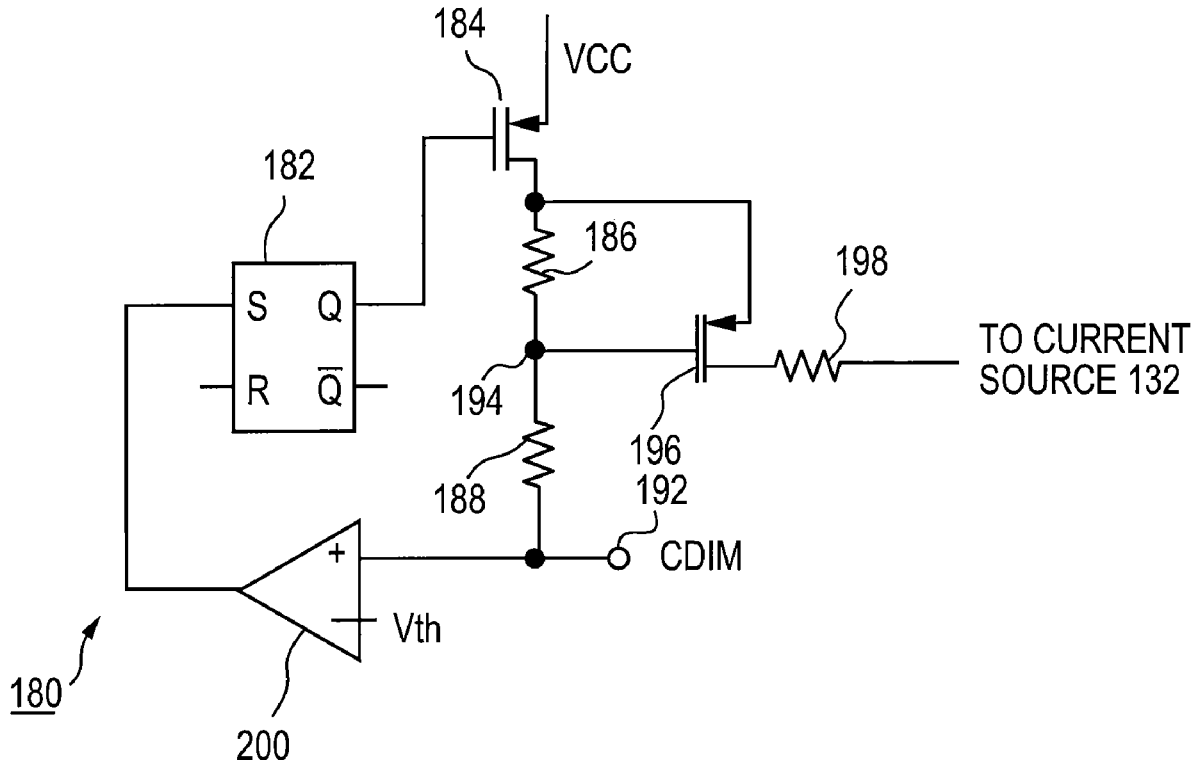
FIG. 21 shows a soft start circuit in the IC of FIG. 18.

Similarly, output signal frequency can be swept downward from a higher frequency to the minimum frequency by a signal from soft start circuitry 180 to current source 142. Flip-flop 182, shown in FIG. 21, is reset prior to startup by appropriate circuitry (not shown) so that transistor 184 is initially turned on at startup, permitting current to flow through resistances 186 and 188 to charge external capacitance 190 through dimming ramp (CDIM) pin 192. Because voltage at node 194 is initially low, transistor 196 is also initially turned on, so that current through transistor 184 is divided, with some current flowing through resistance 198 to current source 132 and thence to capacitor 130, permitting rapid charging and a higher output signal frequency.

As voltage at node 194 rises due to charging of capacitance 190, transistor 196 is turned off, and capacitor 130 charges more slowly, bringing the output signal down to its minimum frequency. Then, voltage on CDIM pin 192 rises until it exceeds threshold voltage Vth. At this time, comparator 200 provides a high signal, setting flip-flop 182 and thus turning off transistor 184, so that soft start circuitry 180 is completely switched out and has no further effect on output signal frequency until the next time flip-flop 182 is reset at startup.

Figure 22:
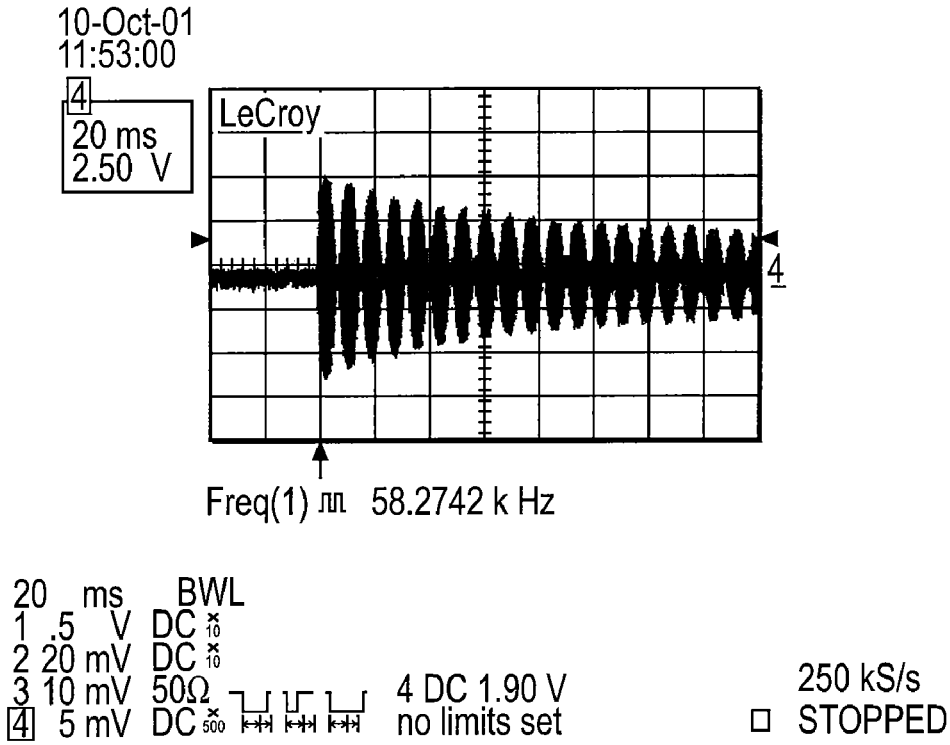
FIGS. 22 and 23 show signals for illustrating lamp current before and after implementation of the soft start circuit, respectively.
Figure 23:
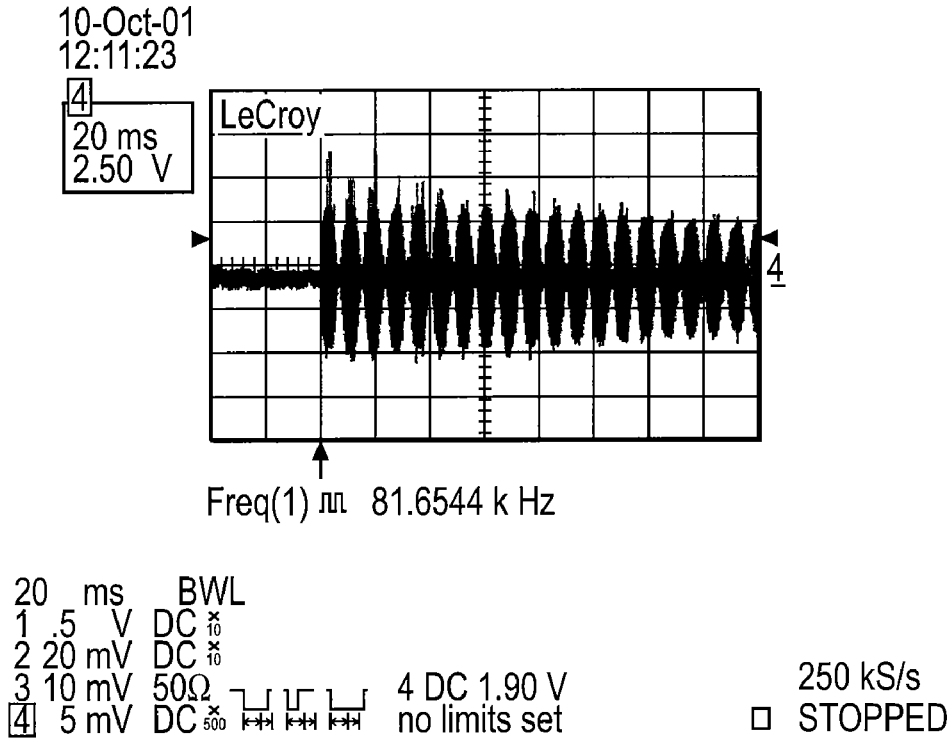

FIGS. 22 and 23 illustrate the effect of soft start circuitry 180 on lamp current at startup. FIG. 22 shows lamp current without soft start circuitry 180, and FIG. 23 shows lamp current with soft start circuitry 180. In FIG. 22, lamp current starts at a higher initial value and falls off to steady state. In FIG. 23, on the other hand, lamp current starts at a lower initial value that is only slightly above steady state, and falls more gradually, thus reducing stress on a lamp's filament at switch on. The lower initial value in FIG. 23 occurs because the higher output signal frequency reduces current flow.

In addition to voltage feedback and soft start control, controlled current source 132 can also be controlled in response to output current sensing. And the frequency of the OSC signal can also be controlled through dead time adjustment, which is accomplished by reset transistor 210 connected across capacitance 130.

Figure 24:
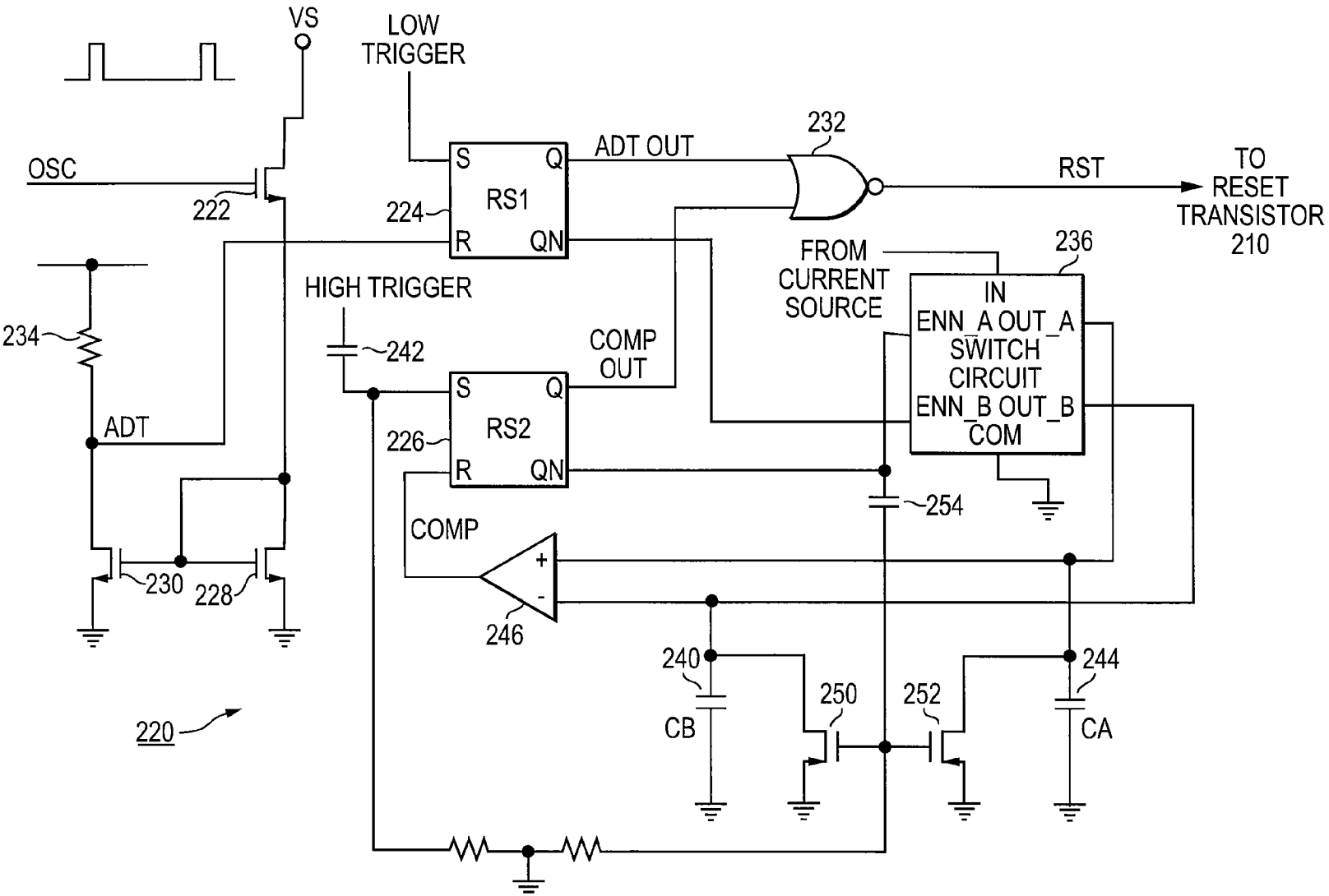
FIG. 24 shows an adaptive dead time circuit in the IC of FIG. 18.
Figure 25:
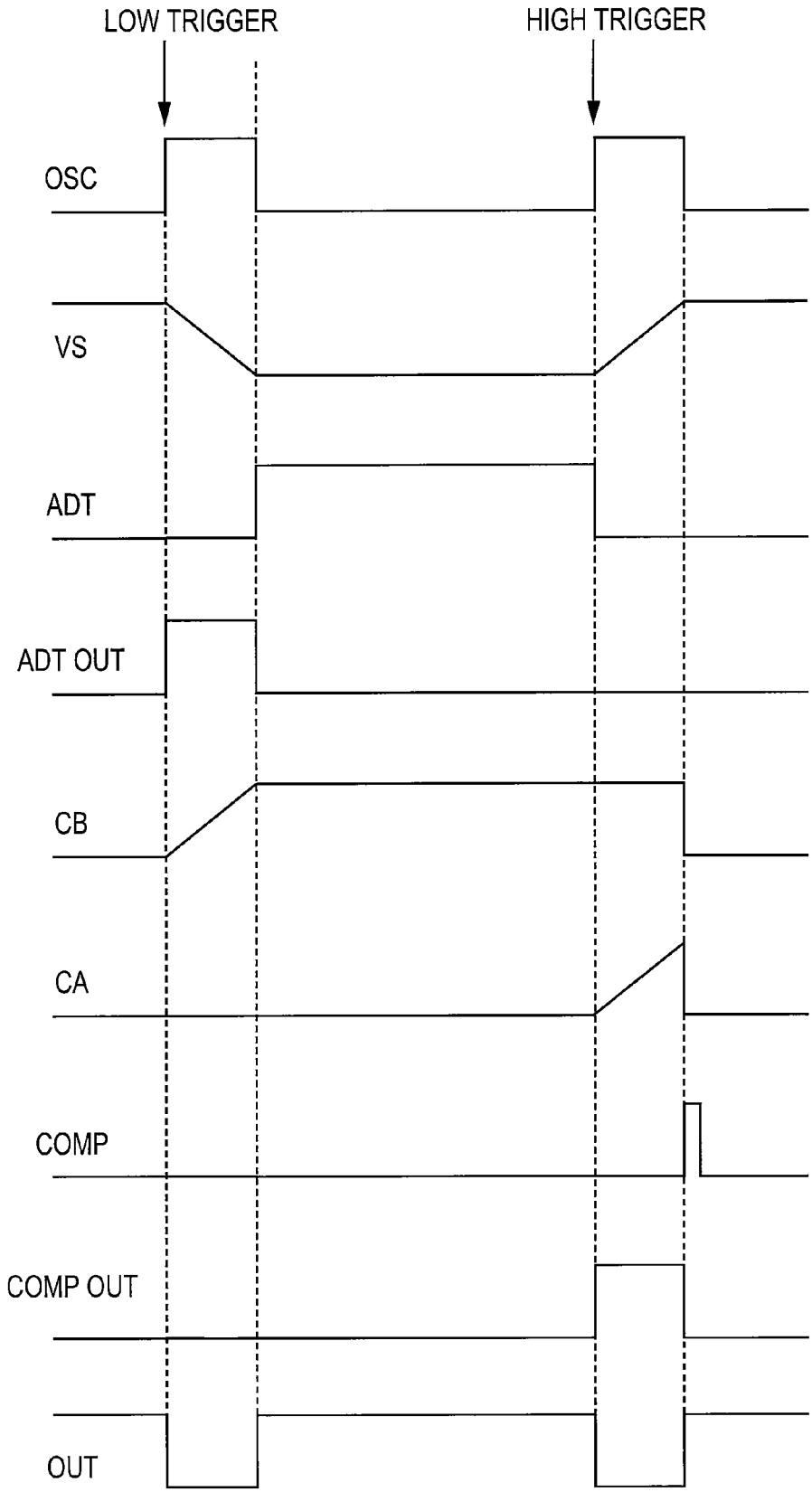
FIG. 25 shows waveforms for illustrating the operation of the adaptive dead time circuit.

FIG. 24 shows adaptive dead time (ADT) circuitry 220, a part of oscillator circuitry 120 that detects dead time on a high to low transition and uses the result to provide a pulsed reset (RST) signal to correct dead time for a low to high transition, allowing cool running power MOSFETs. FIG. 25 shows several waveforms that illustrate operation of circuitry 220.

ADT circuitry 220 receives the output (OSC) signal from oscillator circuitry 120, and also receives low and high trigger pulses indicating rising edges of alternate OSC pulses. The low and high trigger pulses are derived from the OSC signal by appropriate circuitry (not shown). The OSC signal is provided to the gate of transistor 222, while the low and high trigger signals are connected to set flip flop (RS1) 224 and flip flop (RS2) 226, respectively.

The OSC signal goes high to provide dead time between drive signals, but goes low to begin providing a drive signal. The rising edge of a pulse in the OSC signal, indicating the beginning of dead time, turns on transistor 222; circuitry 220 can include logic (not shown) so that the rising edge of a pulse in the OSC signal only turns on transistor 222 during a high to low transition of VS, i.e. every other pulse in the OSC signal. During a high to low transition, shown at left in FIG. 25, voltage on VS pin 62 makes a transition from VBUS voltage to COM voltage, and current flows in transistor 228; therefore transistor 230 is also turned on and holds the ADT signal low. When VS voltage slews all the way to COM voltage, transistor 230 switches off and the ADT signal goes high in response to a supply voltage connected through resistance 234.

The high ADT signal resets flip-flop 224, which was set at the beginning of the high to low transition by a low trigger pulse. The low trigger goes high when HO switches off at the start of the dead time. Consequently the ADT OUT signal is high only during high to low dead time. When flip-flop 224 is reset, its Q output begins providing a low ADT Out signal, and NOR gate 232 responds by providing a high RST signal to reset transistor 210 in FIG. 20, resetting oscillator 60 so that the OSC pulse goes low, terminating the dead time and beginning a new oscillator cycle/timing ramp.

When flip-flop 224 is set by the low trigger pulse at the start of this dead time, its QN output provides a low signal to the ENN_B input of switch circuitry 236, which responds by providing a charging current to capacitance (CB) 240 through its OUT_B lead.

Switching circuit 236 receives current at its IN input from an appropriate current source (not shown), and operates as follows: When its ENN_A and ENN_B inputs are both high, switch circuit 236 connects its IN input to its COM output.

When ENN_A is low, switch circuit 236 connects its IN input to its OUT_A output; when ENN_B is low, switch circuit 236 connects its IN input to its OUT_B output. ADT circuitry 220 ensures that ENN_A and ENN_B are never low at the same time, since at least one of flip-flops 224 and 226 is reset at all times.

When the ADT signal goes high, ENN_B also goes high, so that switch circuit 236 stops charging capacitance 240. As shown in FIG. 25, the voltage across capacitance (CB) 240 stops rising and holds approximately constant, thus storing information about duration of dead time during the OSC pulse at left in FIG. 25.

The rising edge of the subsequent low to high OSC pulse, shown at the right in FIG. 25, indicates the beginning of dead time during a low to high transition in voltage on VS pin 62. As the VS voltage rises, current flow through transistors 222 and 228 turns on transistor 230, allowing the ADT signal to go low. But a high trigger signal pulse received through capacitance 242 at the same time sets flip-flop 226, so that its Q output provides a high COMP Out signal. NOR gate 232 begins providing a low RST signal in response.

When flip-flop 226 is set, its QN output provides a low signal to the ENN_A input of switch circuit 236, causing switch circuit 236 to provide charging current to capacitance (CA) 244. Capacitances CA 244 and CB 240 are connected respectively to the non-inverting and inverting inputs of comparator 246. Therefore, when the voltage on capacitance 244 exceeds the voltage on capacitance 240, comparator 246 begins providing a high COMP signal at its output, resetting flip-flop 226 so that COMP Out goes low. The low COMP Out signal causes NOR gate 232 to provide a high RST signal to reset transistor 210. As a result, the OSC pulse goes low, thus terminating the dead time and beginning a new oscillator cycle/timing ramp.

When flip-flop 226 is reset by the high COMP signal, its QN output goes high. Therefore, switch circuit 236 has high inputs at both ENN_A and ENN_B and neither of capacitors 240 and 244 is being charged. The high QN output provides a pulse through capacitance 254 to the gates of transistor 250 and 252 to discharge capacitances 240 and 244 both to 0V. As a result, the duration of dead time during a low to high VS transition is determined solely by charge stored in capacitance 240 during the immediately preceding high to low transition dead time. As indicated above, the stored charge indicates duration of the high to low transition dead time, so that the dead time durations are coordinated by ADT circuitry 220 without the use of components external to IC 50.

Figure 26:
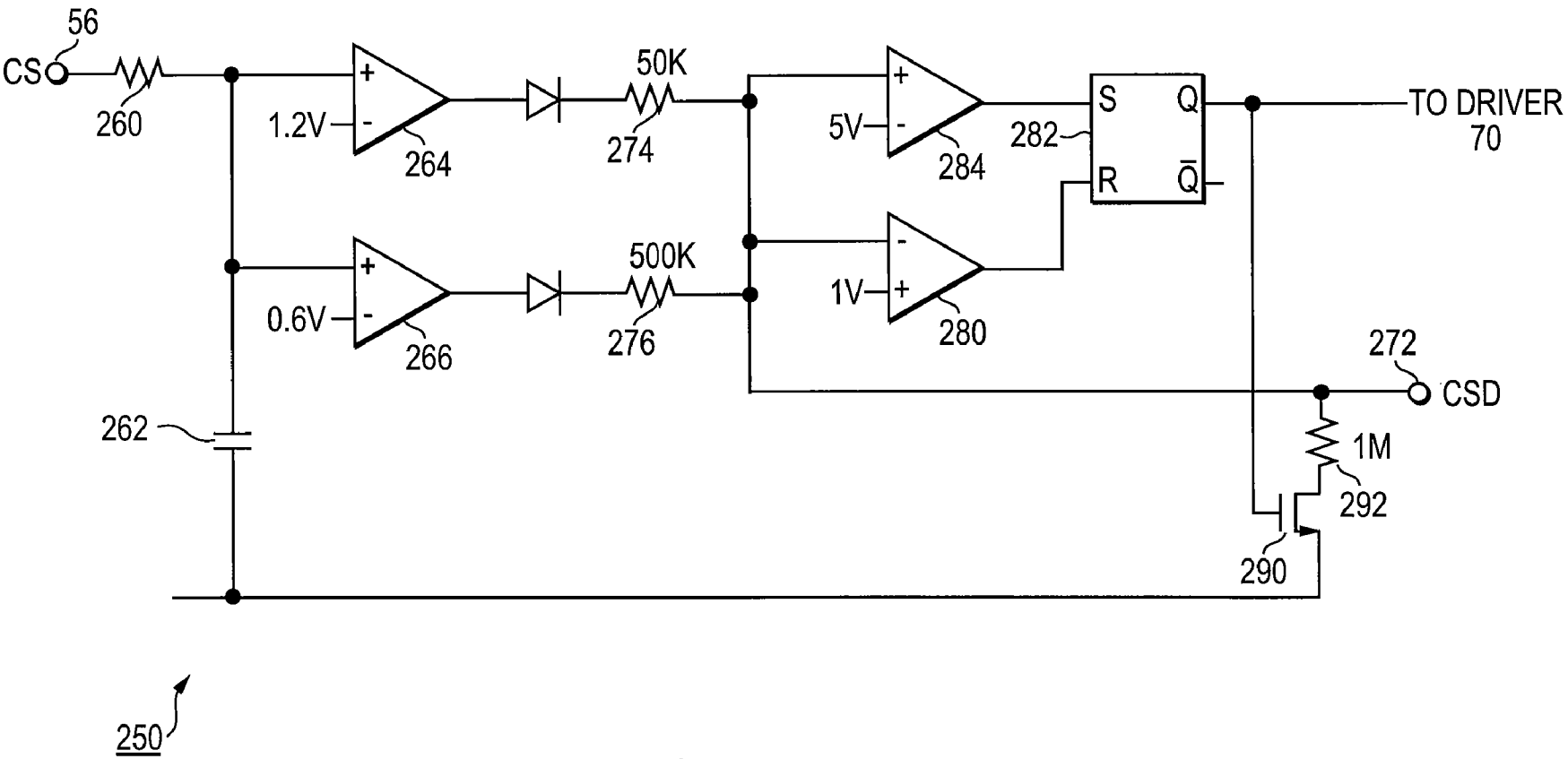
FIG. 26 shows a shutdown circuit in the IC of FIG. 18.

FIG. 26 shows shutdown circuit 250, which includes peak level detect component 252 and timing component 254 in FIG. 18. When an overload or short circuit condition is detected, shutdown circuit 250 provides a disable signal that, when high, causes fault logic 76 to disable the high and low output signals HO and LO. When the overload or short circuit condition ends, shutdown circuit 250 performs auto-resetting.

Voltage on current sensing CS pin 56 is received through current sense resistance 260 and is filtered by capacitance 262 to remove high frequency spikes. The filtered result is provided to the "+" inputs of comparators 264 and 266. Comparator 264 detects short circuit conditions by comparing its "+" input with 1.2V, while comparator 266 detects overload conditions by comparing its "+" input with 0.6V. A high output from either comparator causes charging of external capacitance 270, shown in FIG. 19, through shutdown timing capacitor (CSD) pin 272. But comparator 264 charges capacitance 270 through resistance 274, illustratively 50 Kohms, while comparator 266 charges through resistance 276, illustratively 500 Kohms. As a result of the difference in resistances 274 and 276, comparator 264 charges capacitance 270 more rapidly than comparator 266 does. In other words, detection of a short circuit condition has a short delay, while detection of an overload condition has a long delay.

Until one of comparators 264 and 266 charges capacitance 270 to more than 1V, comparator 280 provides a high output, and flip flop 282 is held in its reset state. Above 1V, comparator 280 provides a low output, permitting flip flop 282 to be set. When capacitance 270 passes 5V, comparator 284 provides a high output that sets flip flop 282 and provides a high disable output, disabling HO and LO outputs. The high disable output also turns on transistor 290, which permits capacitance 270 to discharge through resistance 292, illustratively 1 Mohm to prevent capacitance 270 from discharging while one of comparators 264 and 266 is providing a high output. When capacitance 270 again falls below 1V, comparator 280 again provides a high output, resetting flip flop 282 so that the disable output goes low and HO and LO outputs are no longer disabled.

Figure 27:
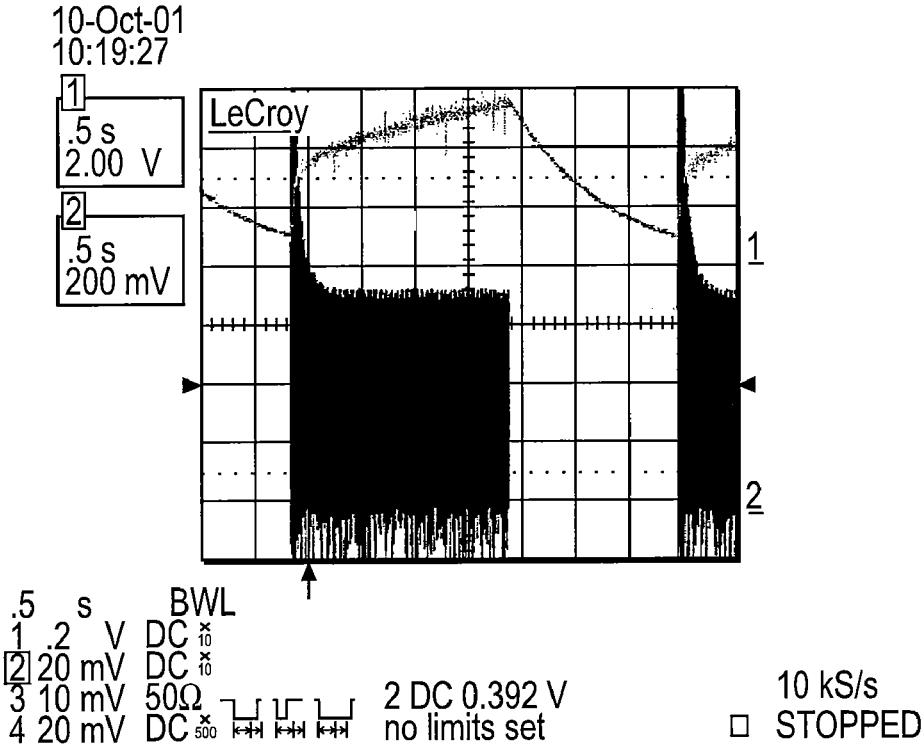
FIGS. 27 and 28 show operation of the shutdown circuit in response to an overload condition and a short circuit condition, respectively.
Figure 28:
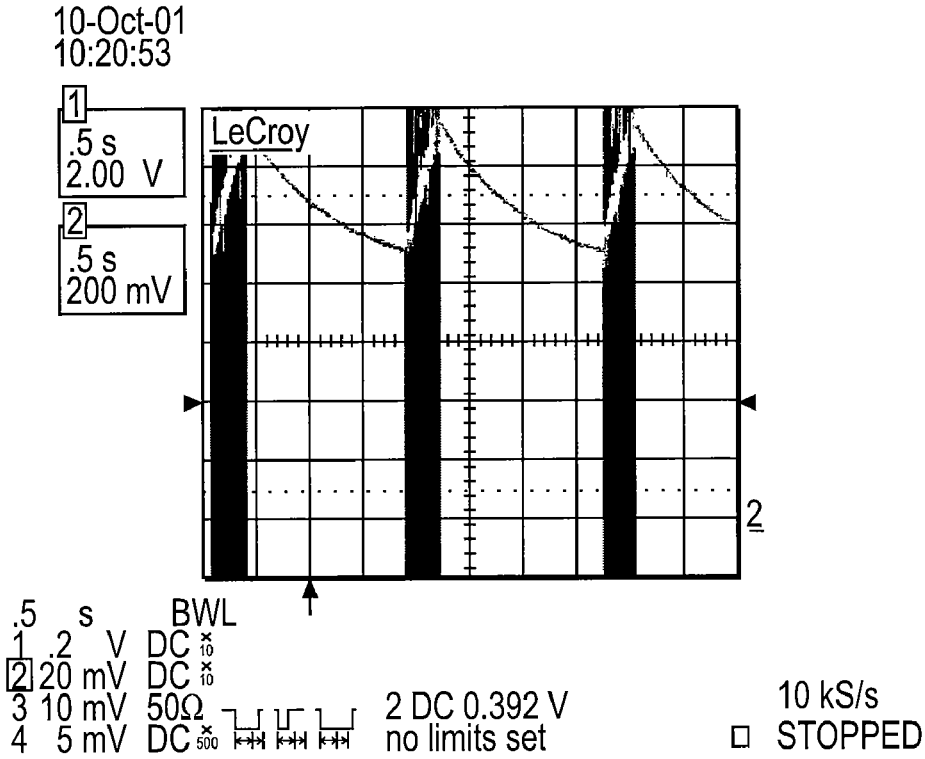

FIGS. 27 and 28 compare operation of shutdown circuit 250 in response to an overload condition, shown in FIG. 27, and a short circuit condition, shown in FIG. 28. Each figure compares a waveform of voltage across current sensing resistance 260 (light grey) with a waveform of voltage across capacitance 270 (dark grey), as measured by voltage at CSD pin 272. As can be seen, shutdown for an overload condition is relatively slow, while shutdown for a short circuit condition is relatively fast. But the delay before restarting is the same fixed time in either case.

As shown in FIG. 19, dim control input (VDIM) pin 300 receives a dim control signal, which can be a DC control voltage provided by a micro-controller (not shown) or other source external to IC. Sample AC line voltage (SYNC) pin 302 receives a signal derived from the AC line voltage received at input pins 86 by circuit 80. In response to these signals, phase cut dimming component 304, shown in FIG. 18, performs trailing edge self-dimming.

Figure 29:
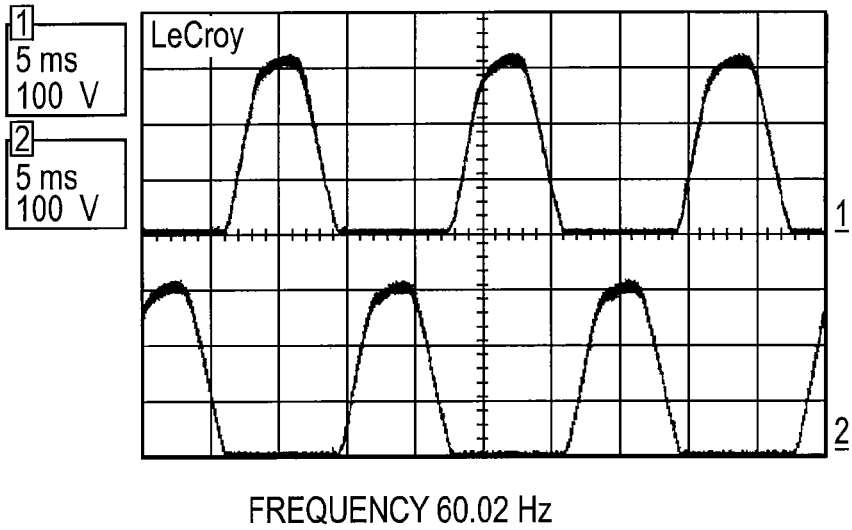
FIG. 29 shows signals for illustrating operation of a dimming circuit in the IC of FIG. 18.

After filtering, illustratively performed by capacitance 90 and inductance 92, the AC line voltage from pins 86 is rectified by diodes 94 and 96 and sensed with reference to the voltage on COM pin 54. FIG. 29 shows the resulting AC half wave signals provided through resistances 310 and 312, each of which can illustratively be 220 Kohms. The two half wave signals are summed at node 314 to provide the signal to the SYNC pin 302.

Figure 30:
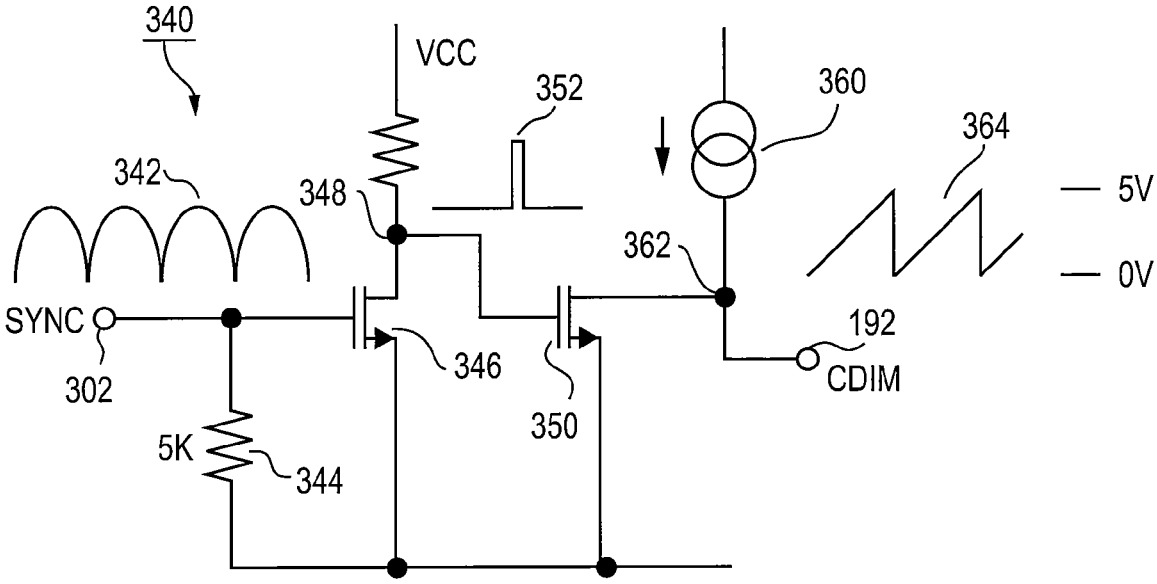
FIG. 30 shows the dimming circuit and relevant signals in the IC of FIG. 18.

The summed half wave signal from SYNC pin 302 is received by dimming ramp circuit 340, as illustrated by waveform 342 in FIG. 30. Circuit 340 is part of phase cut dimming component 304 in FIG. 18, providing a ramp waveform that is synchronized to the AC line voltage. This ramp waveform is provided to one lead of a comparator (not shown) and the dim control signal from VDIM pin 300 is provided to the other, to produce a chopped high frequency output that can serve as an enable signal, as described more fully below. This simple and efficient dimming technique is ideal for filament lamps.

The half wave signal from SYNC pin 302 controls voltage across resistance 344, illustratively 5 Kohms. This voltage turns transistor 346 off as the half wave signal falls at the end of one half cycle, and then back on as the half wave signal rises at the beginning of the next half cycle. When transistor 346 is turned off, voltage at node 348 rises, falling again when transistor 346 is turned on, thus providing a pulsed signal to the gate of transistor 350 as illustrated by waveform 352. During the relatively long period when transistor 350 is off, current source 360 charges external capacitance 190 through dimming ramp (CDIM) pin 192. Since capacitance 190 is also used by soft start circuit 180, current source 360 can only be enabled after completion of soft start, described above in relation to FIGS. 21-23. During charging, voltage at node 362 ramps upward, as illustrated in waveform 364. But when transistor 350 is turned on by a pulse in waveform 352, capacitance 190 discharges through transistor 350, producing a falling edge in waveform 364. After the pulse in waveform 352, charging begins again.

Node 362 can be connected to the "+" lead of a comparator (not shown) and VDIM pin 300 can be connected to the "–" lead. As a result, the comparator provides a rectangular waveform synchronized to the line frequency. For example, the rectangular waveform can remain low until the ramp waveform exceeds the dim control signal, then can go high until the next falling edge in the ramp waveform, so that its duty cycle depends on the dim control signal to VDIM pin 300. The comparator output can be provided to a suitable gate (not shown) to disable and enable the HO and LO outputs from driver 70. In this implementation, the half bridge controlled by driver 70 switches only during the initial portion of each mains cycle, and stops switching thereafter, so that voltage at VS pin 62 is only driven during the initial portion, after which it follows a decay path.

Figure 31:
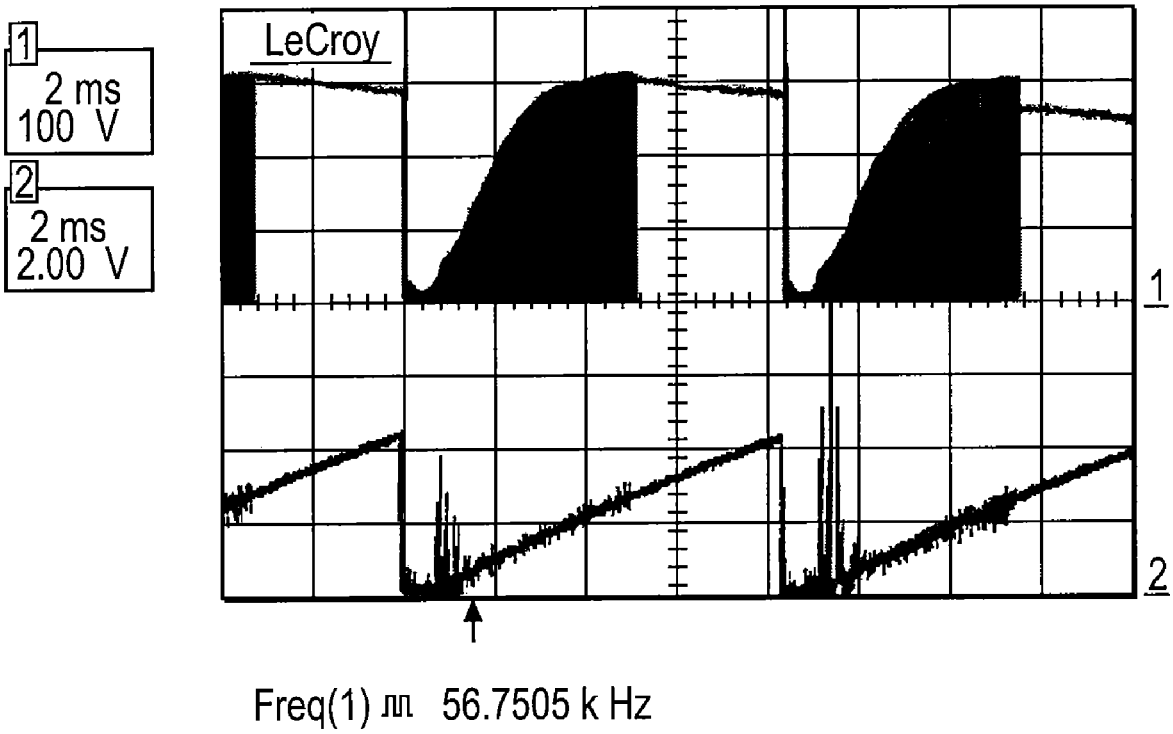
FIG. 31 shows signals for illustrating operation of a dimming circuit in the IC of FIG. 18.

The waveforms in FIG. 31 illustrate operation of phase cut dimming component 304, with the lower waveform showing the ramp waveform voltage at CDIM pin 192 and the upper waveform showing the chopped high frequency output voltage at VS pin 62. By adjusting the dim control signal provided to VDIM pin 300, the duty cycle of the rectangular waveform is varied, adjusting the average output voltage at VS pin 62 between 0% and 100% of its maximum value. Meanwhile, line voltage zero crossings do not affect voltage on the DC bus, which remains at whatever voltage the line voltage was at when the output was disabled by the phase cut dimming because there is no longer any load. As a result, the SYNC signal must be detected before the bridge rectifier.

Bandgap reference 380 in circuit 50 in FIG. 18 can provide Vref, the reference voltage for comparator 142, as well as various other reference voltages. 5V regulator 382 in circuit 50 provides a 5V regulated output voltage for a micro-controller through regulated 5V output (5VOUT) pin 384.

A simpler, lower cost, 8 pin counterpart of IC 50 has also been produced having these features as described above, but with a simpler regulation scheme.

The new ICs described above are expected to be the first commercially available ICs for driving halogen lamps, and their applications may be extendible to other filament lamps. An implementation of these new ICs can be highly reliable, can have greater functionality than existing circuits, and can potentially be produced at low cost. Good experimental results have been obtained.

What is claimed is:

1. A control circuit implemented in an integrated circuit for providing a drive signal to a power semiconductor device for providing an output power signal to a filament lamp, said control circuit comprising:

an oscillator for generating an oscillating control signal; and a driver receiving said oscillating control signal and producing said drive signal;

a dimming control circuit which controls said oscillator for dimming said lamp;

wherein said dimming circuit comprises a first circuit having a dimming signal as an input, said dimming signal comprising a variable voltage level setting a dimming level, and further having a synchronizing signal as an input derived from a full wave rectified AC line signal waveform;

the first circuit producing a pulsed synchronizing signal for synchronizing a ramp signal developed across a capacitor to said full wave rectified AC line signal waveform;

further comprising a second circuit receiving said dimming signal and said ramp signal and producing a rectangular waveform synchronized to said full wave rectified AC line signal waveform, said rectangular waveform having a duty cycle related to the voltage level of said dimming signal and being provided as an input to said oscillator to generate said oscillating control signal, whereby said oscillating control signal drives the driver to produce the drive signal for the power semiconductor device to produce the output power signal comprising a phase cut oscillating signal synchronized to said full wave rectified AC line signal waveform and having a phase cut component determined by the voltage level of said dimming signal.

2. The circuit of claim 1, wherein said control circuit has a soft-start mode responsive to a low input voltage at lamp startup, and wherein said dimming control circuit provides a low input voltage threshold preventing operation in said soft-start mode unless said input voltage falls below said low input voltage threshold.

3. The circuit of claim 2, said control circuit further comprising:

a soft start circuit providing said soft-start mode by controlling said oscillator so as to avoid excessive current in said lamp at start-up by starting said oscillator initially at a high frequency corresponding to a reduced output voltage to such lamp, and thereafter reducing said oscillator frequency so as to increase said output voltage;

a voltage compensation circuit which controls said oscillator so as to compensate for variations in load by changing output voltage in response to variations in output load; and a shutdown circuit for shutting down said oscillator in response to a fault condition including both overload and short circuit conditions; and a single CSD pin connected to a capacitor CSD, said CSD pin being selectively connected by control logic to said soft-start circuit, said voltage compensation circuit, and said shutdown circuit.

4. The circuit of claim 2, further comprising:

a soft start circuit providing said soft-start mode by controlling said oscillator so as to avoid excessive current in said lamp at start-up by starting said oscillator initially at a high frequency corresponding to a reduced output voltage to said lamp, and thereafter reducing said oscillator frequency so as to increase said output voltage.

5. The circuit of claim 4, wherein said high frequency is over 100 kHz and said reduced frequency is about 30 kHz.

6. The circuit of claim 5, wherein said high frequency is about 250 kHz.

7. The circuit of claim 4, wherein said oscillation frequency is reduced over a predetermined soft start time.

8. The circuit of claim 7, wherein said soft start time is determined by the time for a current source to charge a capacitor CSD to a predetermined voltage.

9. The circuit of claim 8, wherein said capacitor CSD is connected to a single CSD pin of said integrated circuit.

* * * * *